US010866546B2

(12) United States Patent
Isono et al.

(10) Patent No.: US 10,866,546 B2
(45) Date of Patent: Dec. 15, 2020

(54) IMAGE HEATING APPARATUS IN WHICH THE TEMPERATURE IS CONTROLLED BY A HIGH FREQUENCY VOLTAGE SUPPLIED TO AN EXCITATION COIL

(71) Applicant: CANON KABUSHIKI KAISHA, Tokyo (JP)

(72) Inventors: Aoji Isono, Naka-gun (JP); Minoru Hayasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/583,841

(22) Filed: Sep. 26, 2019

(65) Prior Publication Data

US 2020/0103795 A1 Apr. 2, 2020

(30) Foreign Application Priority Data

Sep. 27, 2018 (JP) ..... 2018-181251

(51) Int. Cl.
*G03G 15/20* (2006.01)
*G03G 15/16* (2006.01)

(52) U.S. Cl.
CPC ..... *G03G 15/2039* (2013.01); *G03G 15/167* (2013.01); *G03G 15/2017* (2013.01)

(58) Field of Classification Search
CPC ..... G03G 15/2017; G03G 15/2039; G03G 15/2053; G03G 15/167
See application file for complete search history.

(56) References Cited

U.S. PATENT DOCUMENTS

| | | | | |
|---|---|---|---|---|
| 9,176,441 | B2 * | 11/2015 | Yonekubo | G03G 15/2053 |
| 9,323,186 | B2 | 4/2016 | Kita et al. | |
| 9,348,277 | B2 | 5/2016 | Hayasaki et al. | |
| 9,442,440 | B2 | 9/2016 | Hashiguchi et al. | |
| 9,501,010 | B2 | 11/2016 | Itoh et al. | |
| 9,547,264 | B2 | 1/2017 | Kurata et al. | |
| 9,606,482 | B2 | 3/2017 | Hayasaki et al. | |
| 2007/0122173 | A1 * | 5/2007 | Mitsuoka | G03G 15/2039 399/69 |
| 2020/0103800 | A1 | 4/2020 | Nishizawa et al. | |

FOREIGN PATENT DOCUMENTS

| | | | |
|---|---|---|---|
| JP | 2008-197135 | A | 8/2008 |
| JP | 2011-253682 | A | 12/2011 |
| JP | 2016-024367 | A | 2/2012 |
| JP | 2016-029460 | A | 3/2013 |
| JP | 2014-102307 | A | 6/2014 |

* cited by examiner

*Primary Examiner* — Sophia S Chen
(74) *Attorney, Agent, or Firm* — Venable LLP

(57) ABSTRACT

An image heating apparatus includes an electroconductive cylindrical member, an opposing member thereto, a nip forming member cooperating with the opposing member to form a nip configured to nip and feed a recording material, a magnetic field generating device, a converter, a temperature detector for the rotatable member, and a converter controller. The magnetic field generating device includes an excitation coil in an inside space of the rotatable member so that a helicity axis of the excitation coil is in parallel with an axial direction of the rotatable member to produce an induced current in a circumferential direction of the rotatable member. The converter applies a high frequency voltage to the coil. The controller controls the temperature of the rotatable member by controlling at least one of a pulse period, a pulse-on time, a burst period, and a burst-on time.

8 Claims, 21 Drawing Sheets

(a)

(b)

(a)

(b)

IMAGE HEATING APPARATUS IN WHICH THE TEMPERATURE IS CONTROLLED BY A HIGH FREQUENCY VOLTAGE SUPPLIED TO AN EXCITATION COIL

CROSS-REFERENCE TO RELATED APPLICATIONS

This application claims the benefit of Japanese Patent Application No. 2018-181251 filed on Sep. 27, 2018, which is hereby incorporated by reference herein in its entirety.

FIELD OF THE INVENTION AND RELATED ART

The present invention relates to an image heating apparatus which is mountable in an image forming apparatus that employs an electrophotographic image forming method or the like. More specifically, the present invention relates to an image heating apparatus that employs a heating method based on electromagnetic induction.

Various image heating apparatuses use a heating method based on electromagnetic induction are available. Some of these image heating apparatuses are designed to control a rotational heating member in heating range by switching the driving frequency of the high frequency converter based on recording medium size (Japanese Laid-open Patent Application No. 2016-29460). There have also been image heating apparatuses that are provided with first and second high frequency converters and are designed to control the second high frequency converter by switching the first high frequency converter based on recording medium size to control the power supply to the apparatus (Japanese Laid-open Patent Application No. 2016-24367).

For image heating apparatus based on electromagnetic induction, it has been thought that designing the apparatus to control the temperature of the rotational member by controlling the high frequency converter, and also, to control the heat generation pattern in terms of the lengthwise direction of the rotational member, make the image heating apparatus complicated in structure. Thus, there is desired an image heating apparatus that employs a heating method based on electromagnetic induction, and yet, is simpler in the structure for controlling the temperature of the rotational member and the heat generation pattern in the lengthwise direction of the rotational member, than any conventional heating apparatus based on electromagnetic induction.

Thus, the primary object of the present invention is to provide an image heating apparatus which uses a heating method based on electromagnetic induction, and yet, is simpler in the structure for controlling the temperature of the rotational member and also, the heat generation pattern in terms of the lengthwise direction of the rotational member, than any conventional image heating apparatus which uses a heating method based on electromagnetic induction.

SUMMARY OF THE INVENTION

According to one aspect, the present invention provides an image heating apparatus includes a cylindrical rotatable member, an opposing member, a nip forming member, a magnetic field generating device, a converter, at least one temperature detector, and a controller. The cylindrical rotatable member is provided with an electroconductive layer. The opposing member contacts an outer surface of the rotatable member. The nip forming member contacts an inner surface of the rotatable member and cooperates with the opposing member to form a nip configured to nip and feed a recording material carrying a toner image through the rotatable member. The magnetic field generating device includes an excitation coil provided in an inside space of the rotatable member so that a helicity axis of the excitation coil is parallel with an axial direction of the rotatable member. The magnetic field generating device produces an induced current in a circumferential direction of the rotatable member by supplying an AC current to the excitation coil. The converter is configured to apply a high frequency voltage to the excitation coil. The temperature detector is configured to detect a temperature of the rotatable member. The controller is configured to control the converter. Control parameters relating to the high frequency voltage of the converter include four control times including a pulse period, a pulse-on time, a burst period, and a burst-on time. The controller controls the temperature of the rotatable member by controlling at least one of the four control times.

Further features of the present invention will become apparent from the following description of exemplary embodiments with reference to the attached drawings.

BRIEF DESCRIPTION OF THE DRAWINGS

FIG. 1 shows the general structure of the apparatus.

Figure 5A:
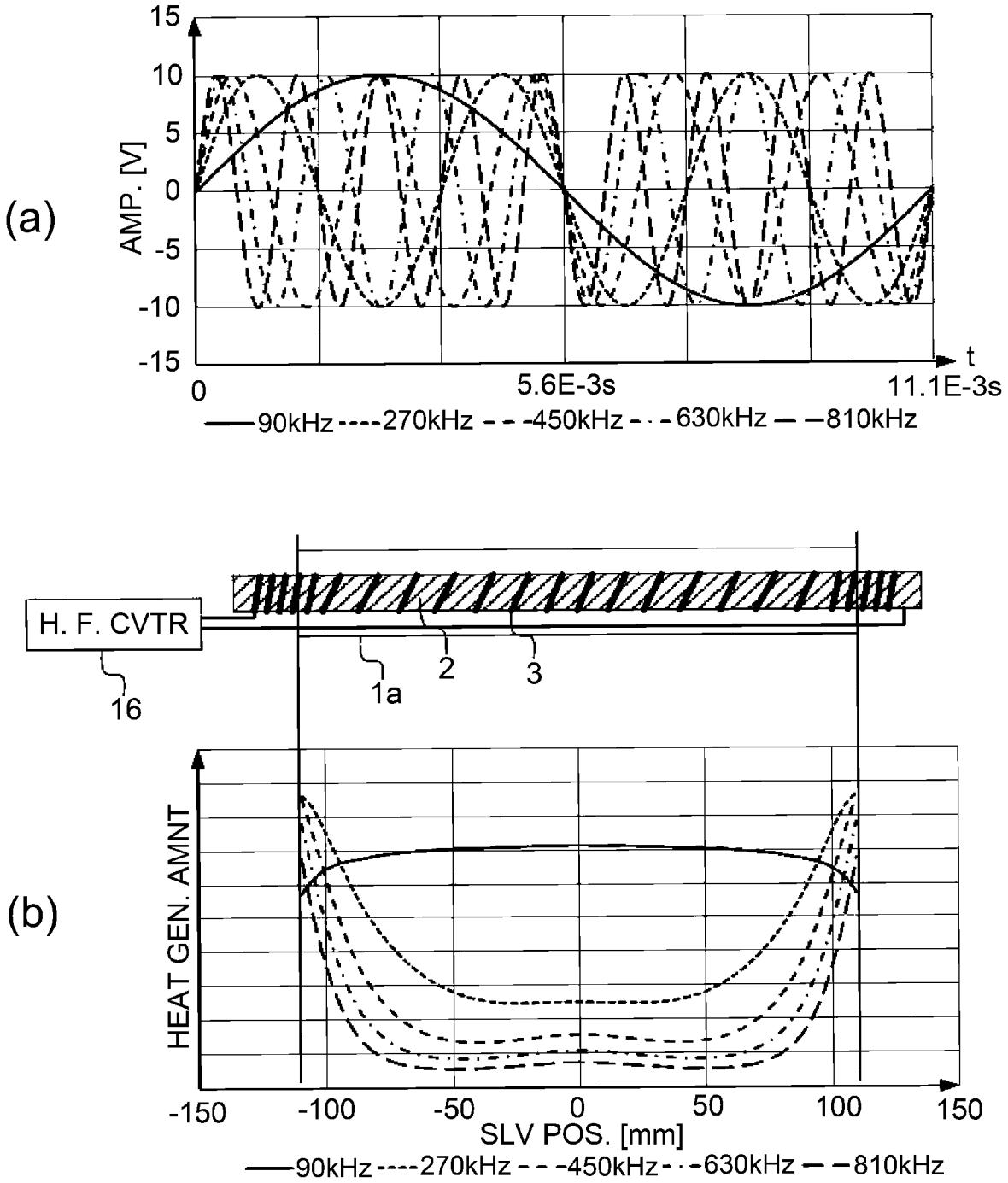
Figure 5B:
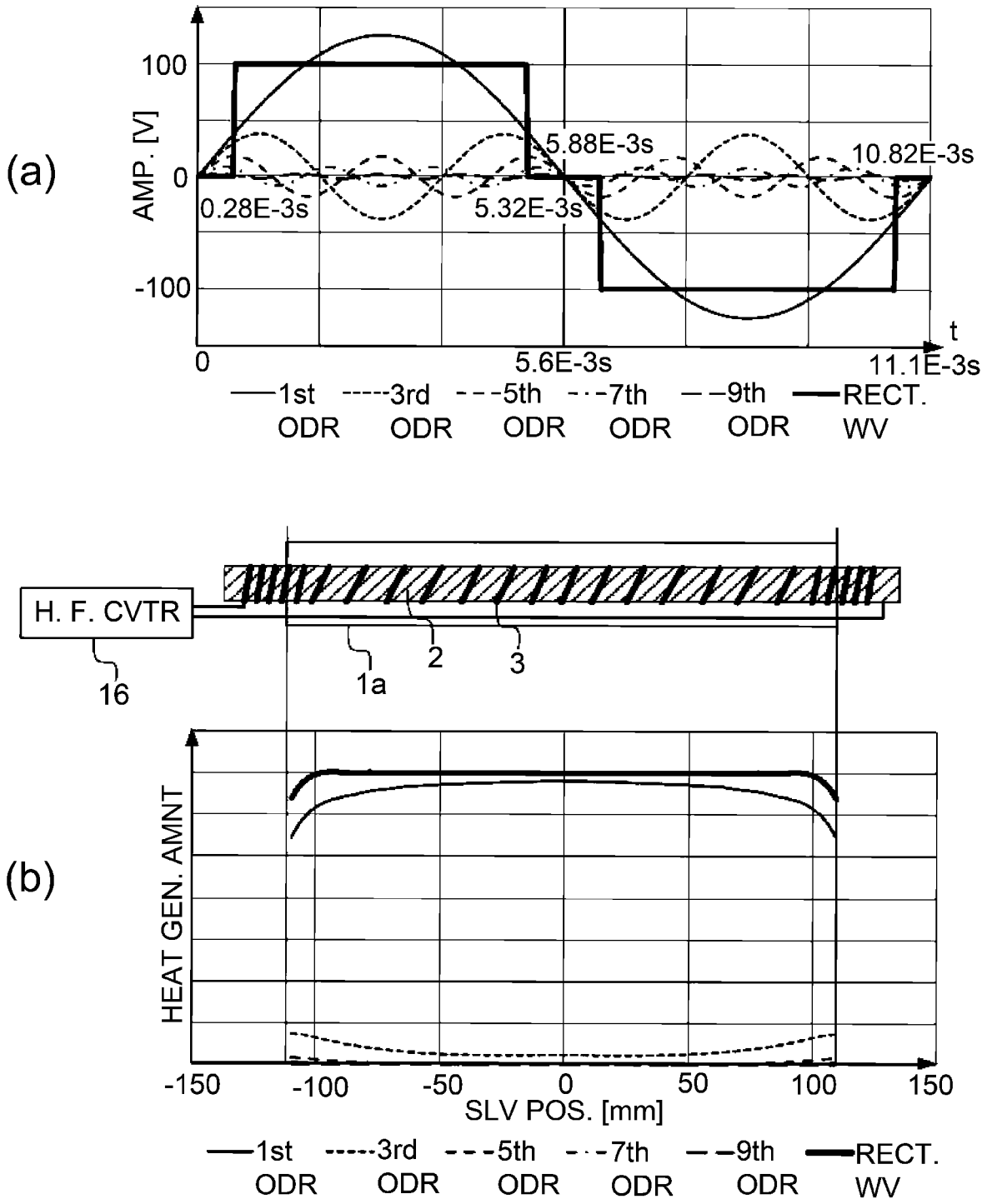

Parts (a) and (b) of FIGS. 5A and 5B are graphs showing the relationship between the waveform of the high frequency voltage for the fixing apparatus in the first embodiment and the heat generation pattern of the rotational member of the apparatus.

Figure 6:
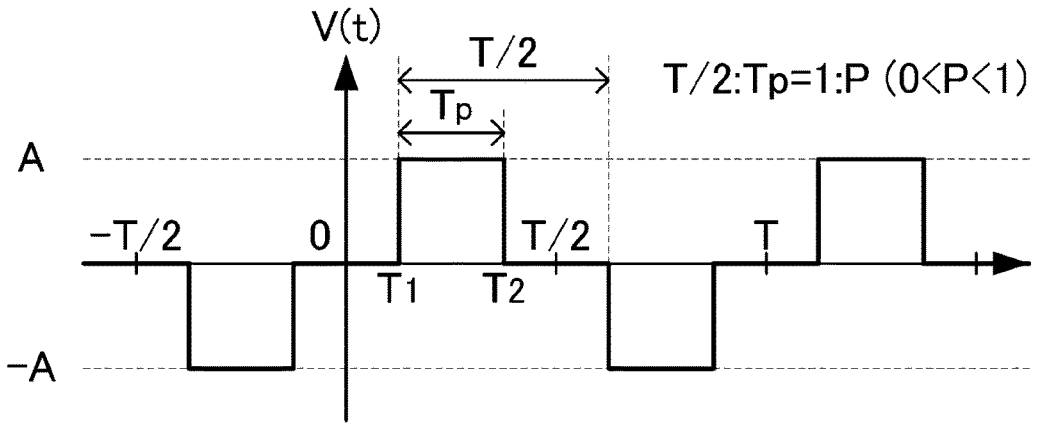

FIG. 6 is a drawing illustrating voltage which has an ordinary rectangular waveform.

Figure 7:
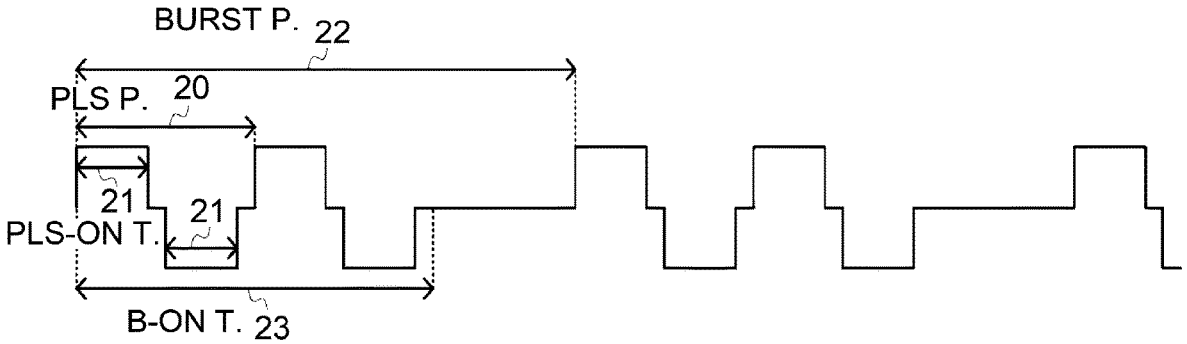

FIG. 7 is a drawing of the waveform of the high frequency voltage outputted by the high frequency converter of the fixing apparatus in the first embodiment.

Figure 8:
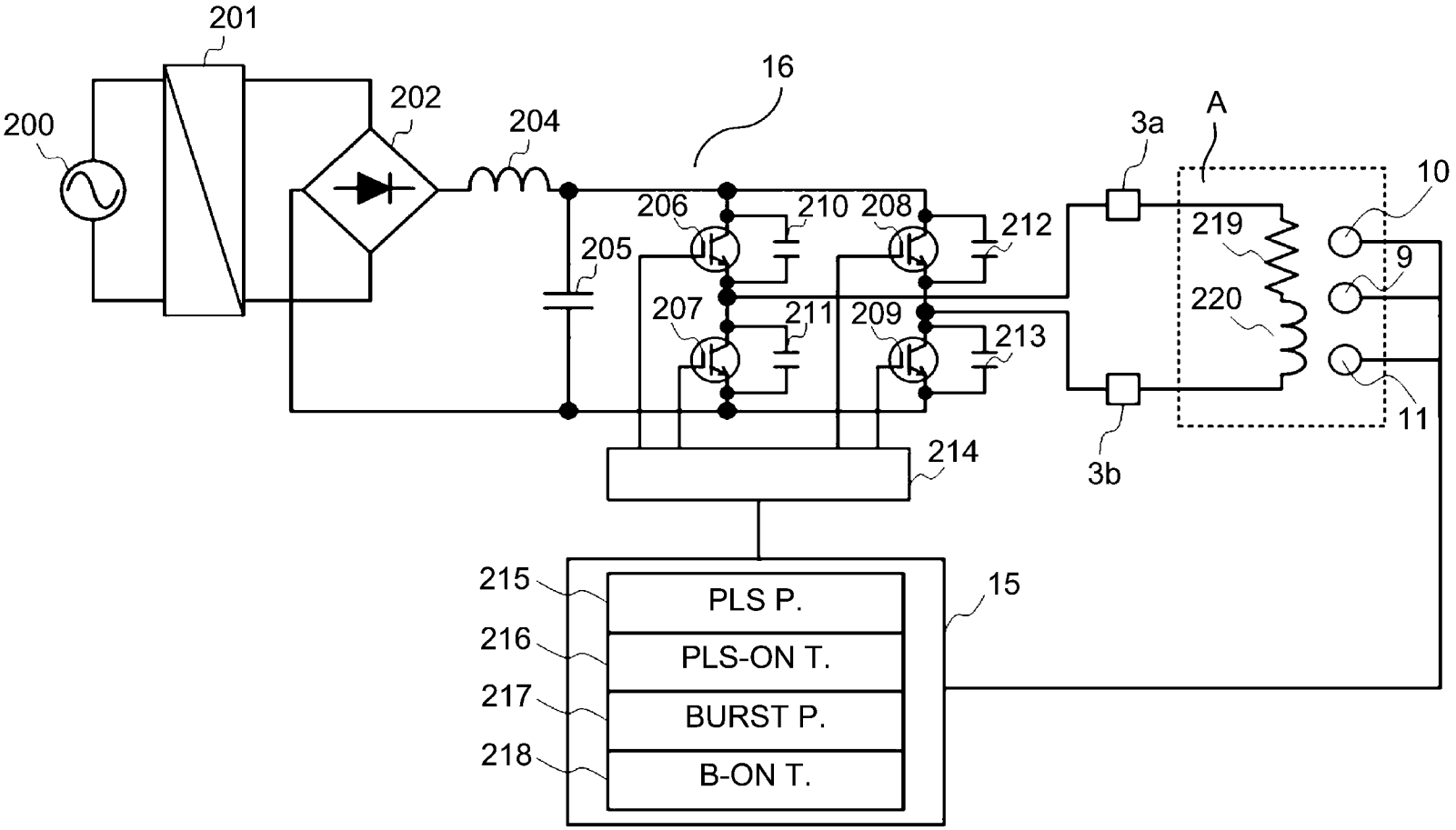

FIG. 8 is a drawing illustrating the circuit of the high frequency converter in the first embodiment.

Figure 9:
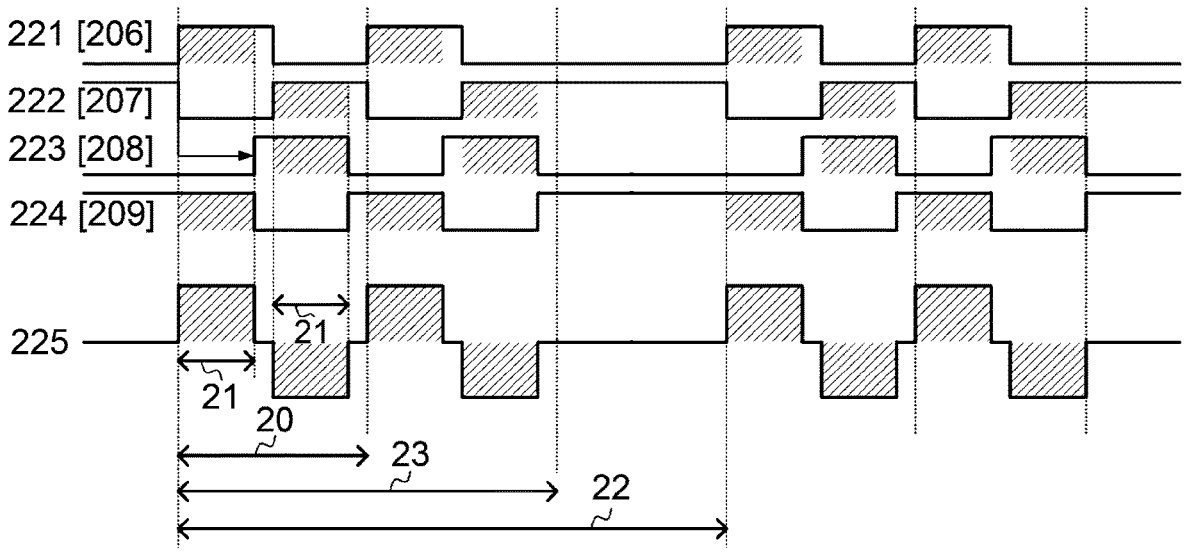

FIG. 9 is a drawing illustrating the control of the switching elements of the high frequency converter.

Figure 10:
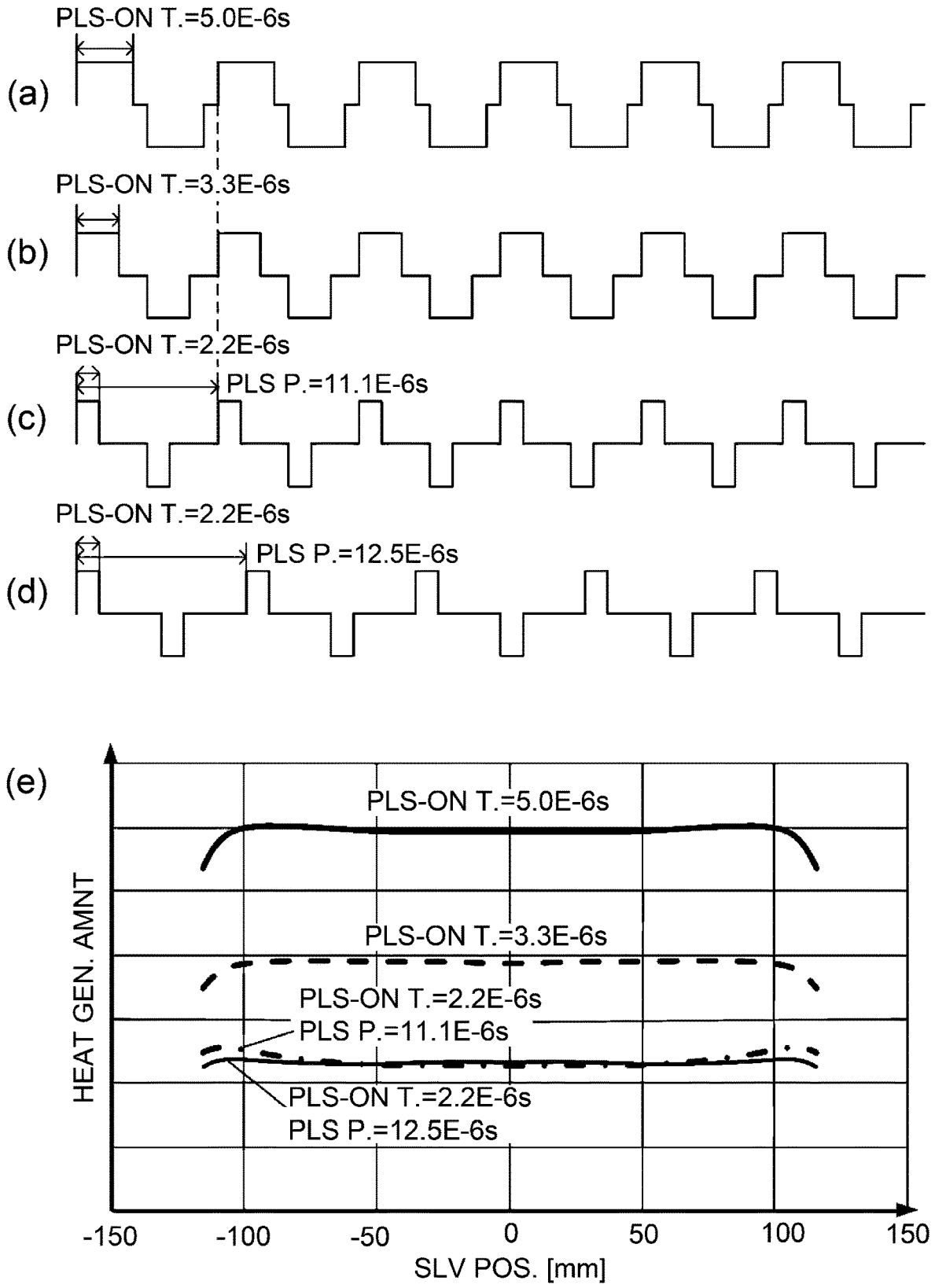

Parts (a)-(e) of FIG. 10 show the temperature control of the rotational heating member of the heating apparatus in the first embodiment.

Figure 11:
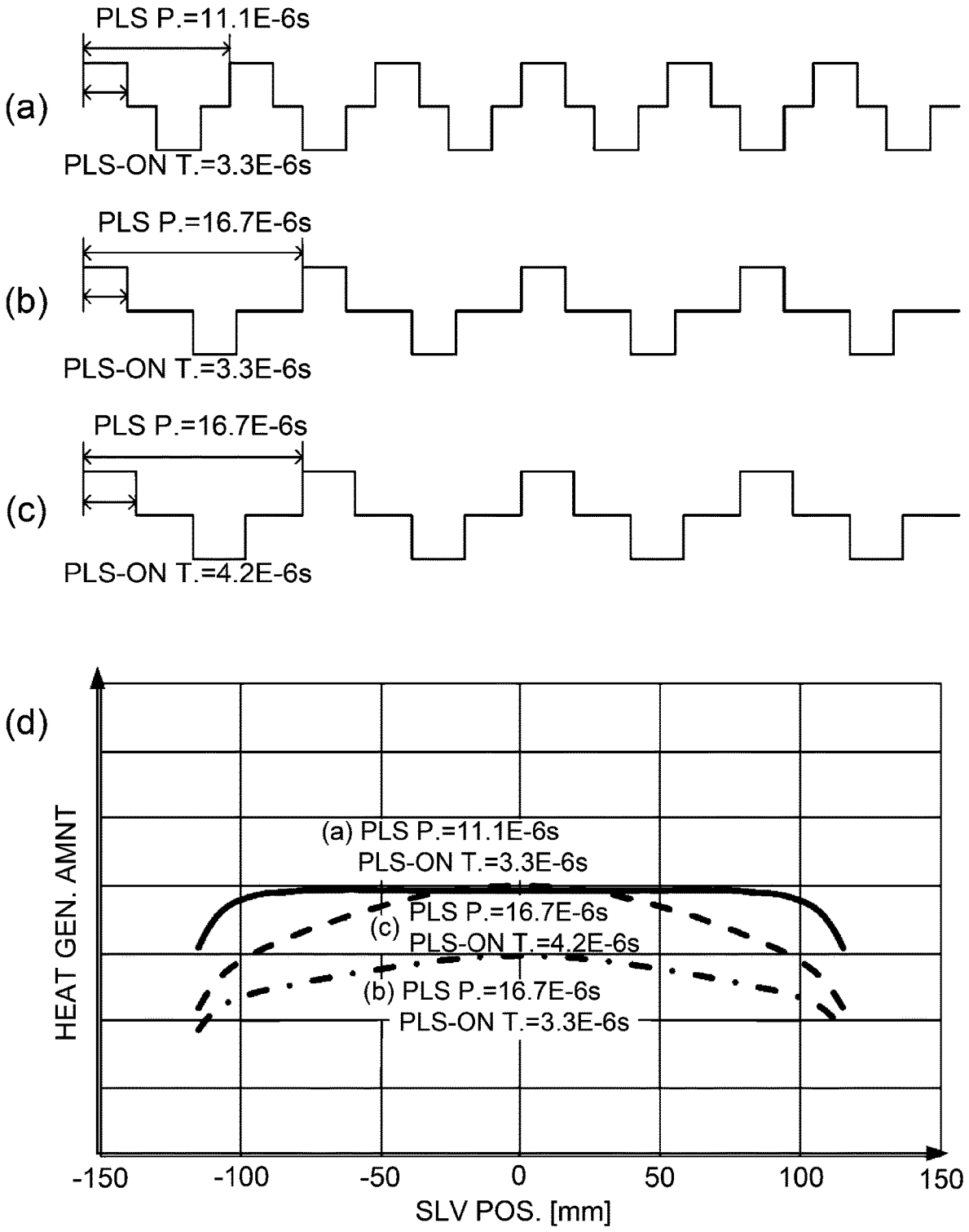

Parts (a)-(d) of FIG. 11 show the control of the heat generation range of the rotational heating member of the fixing apparatus in the first embodiment.

Figure 12:
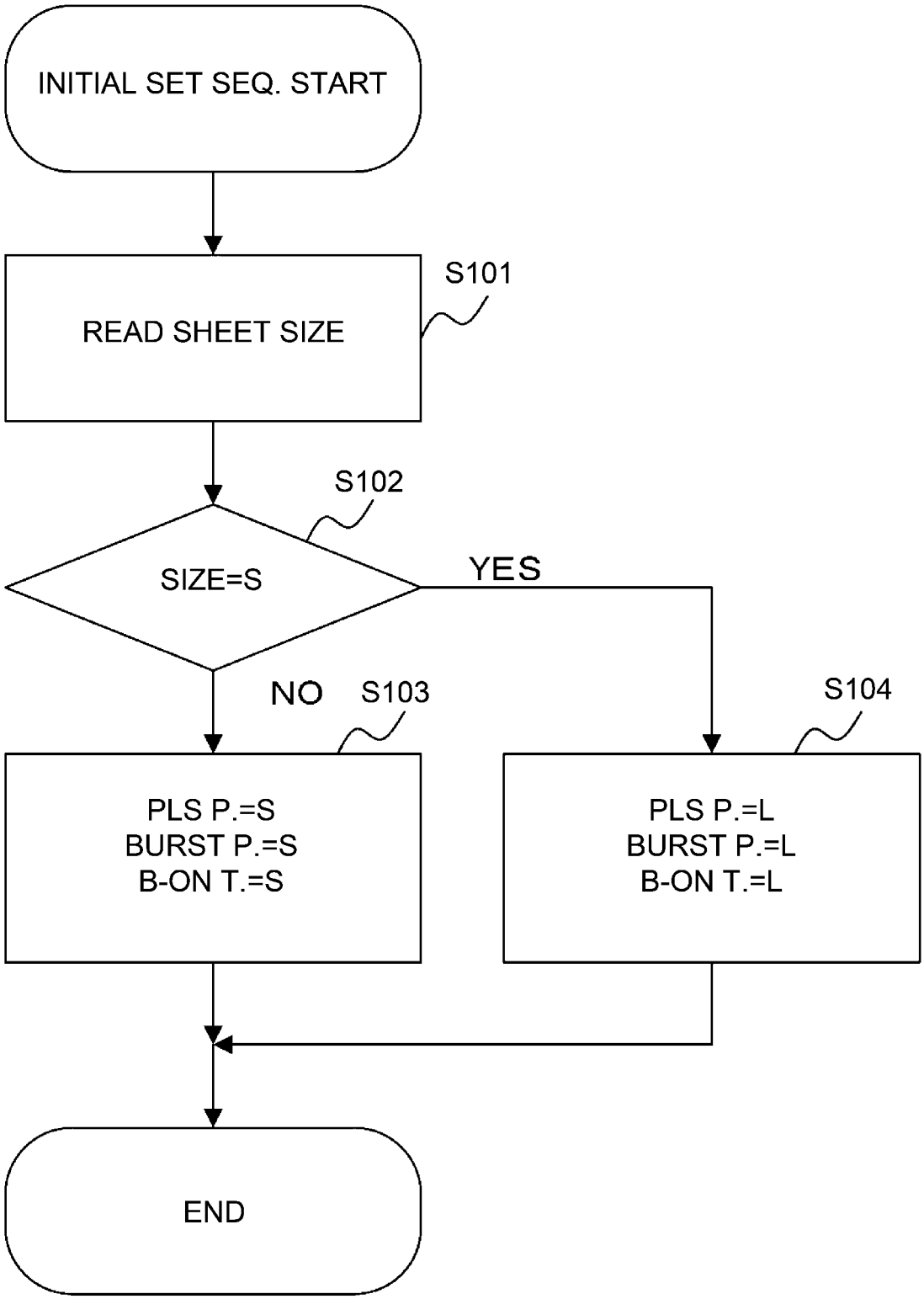

FIG. 12 is a flowchart of the operational sequence for setting values for the control parameters in a second embodiment of the present invention.

Figure 13:
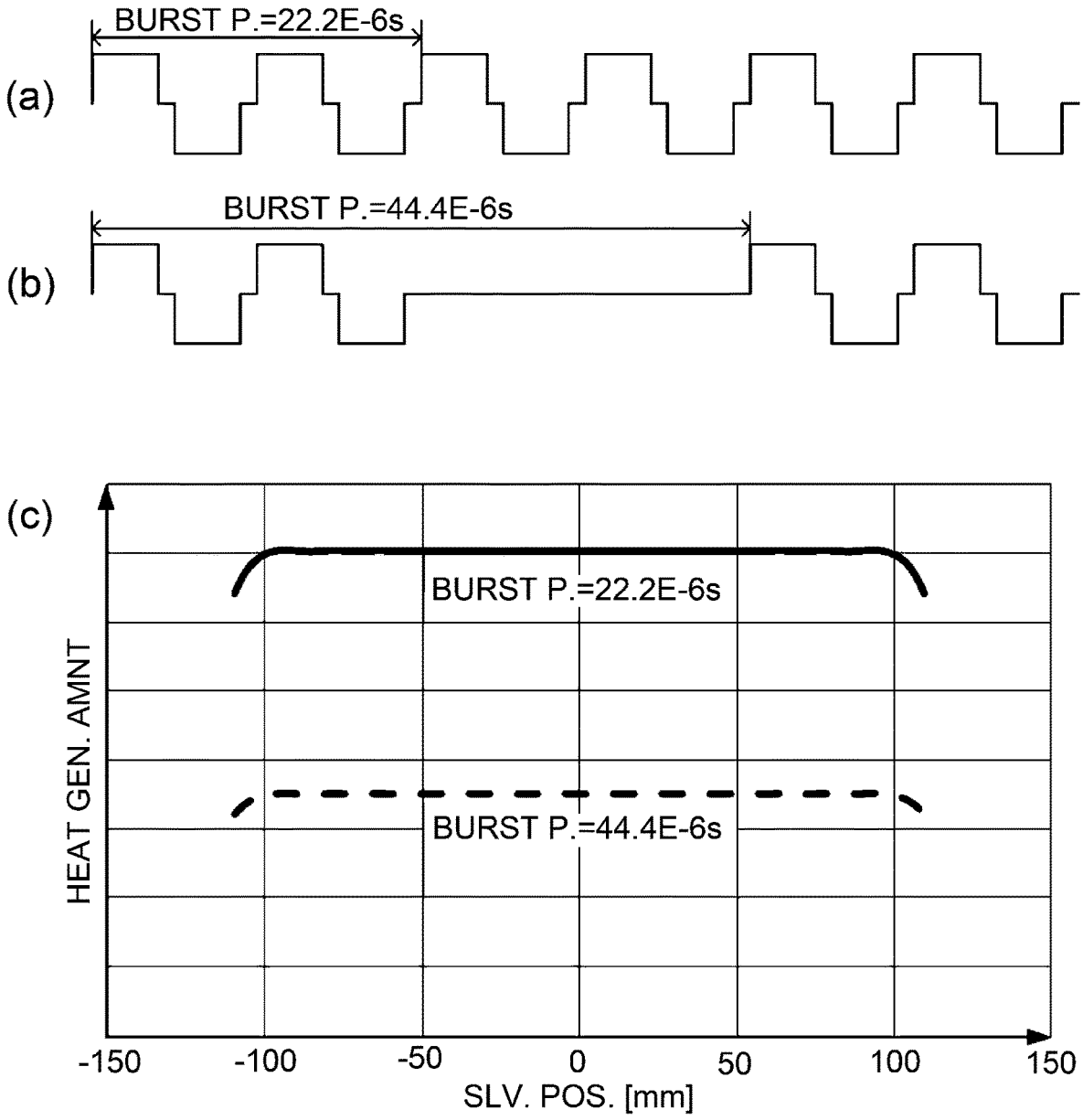

Parts (a)-(c) of FIG. 13 show the temperature control of the fixing apparatus in a third embodiment of the present invention.

Figure 14:
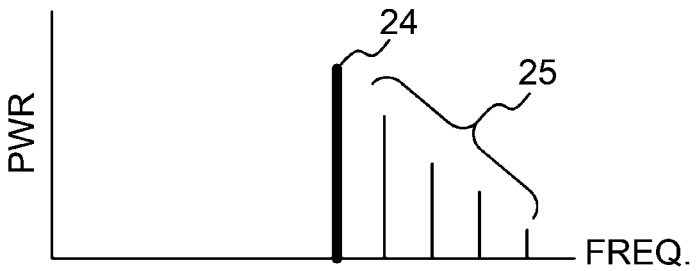
Figure 14:
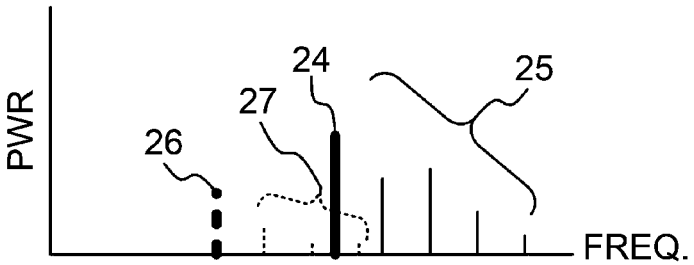

Parts (a) and (b) of FIG. 14 show the power spectrum of the high frequency voltage in the third embodiment.

Figure 15:
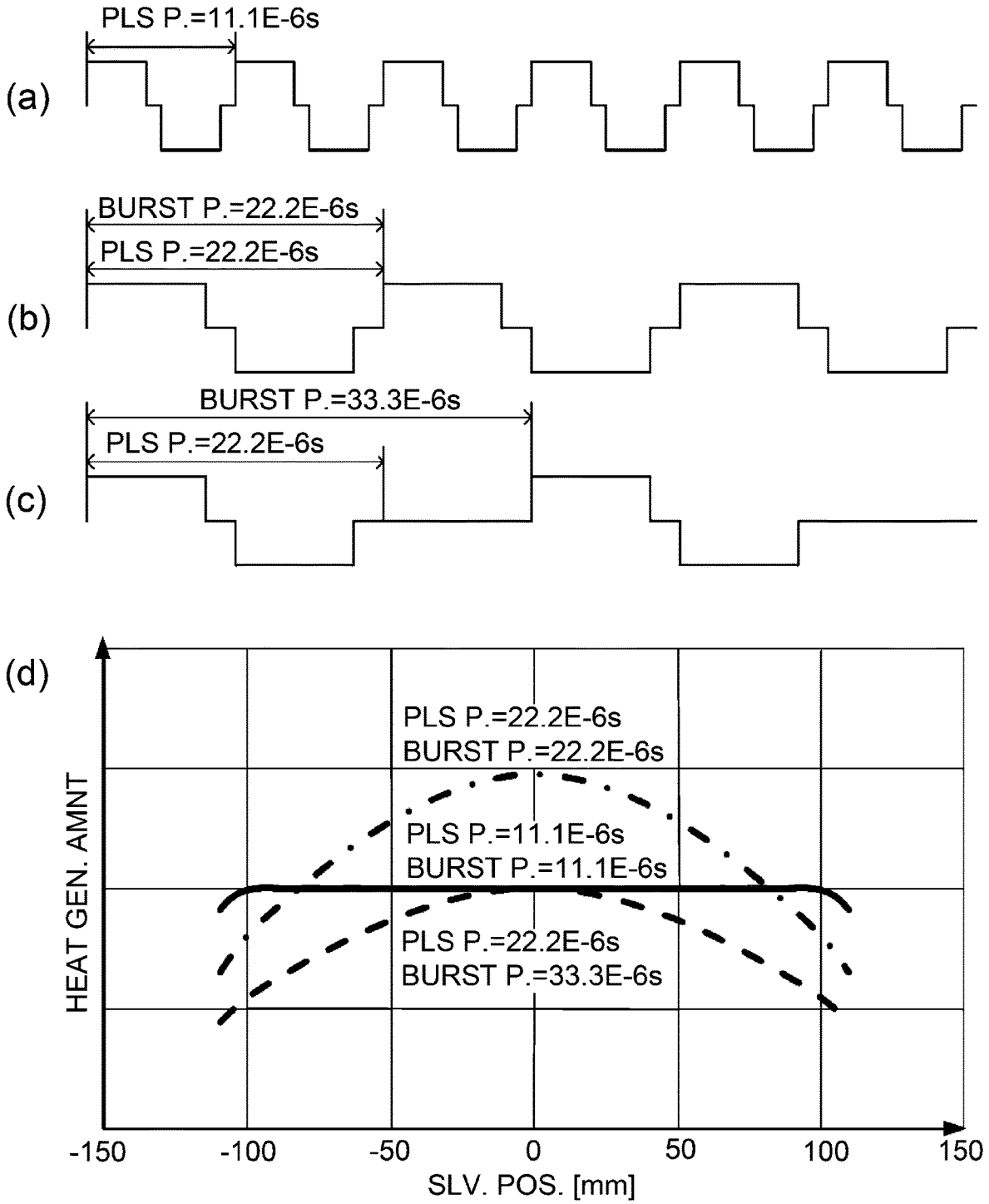

Parts (a)-(d) of FIG. 15 show the control of the heat generation range of the rotational heating member of the fixing apparatus in the third embodiment.

Figure 16:
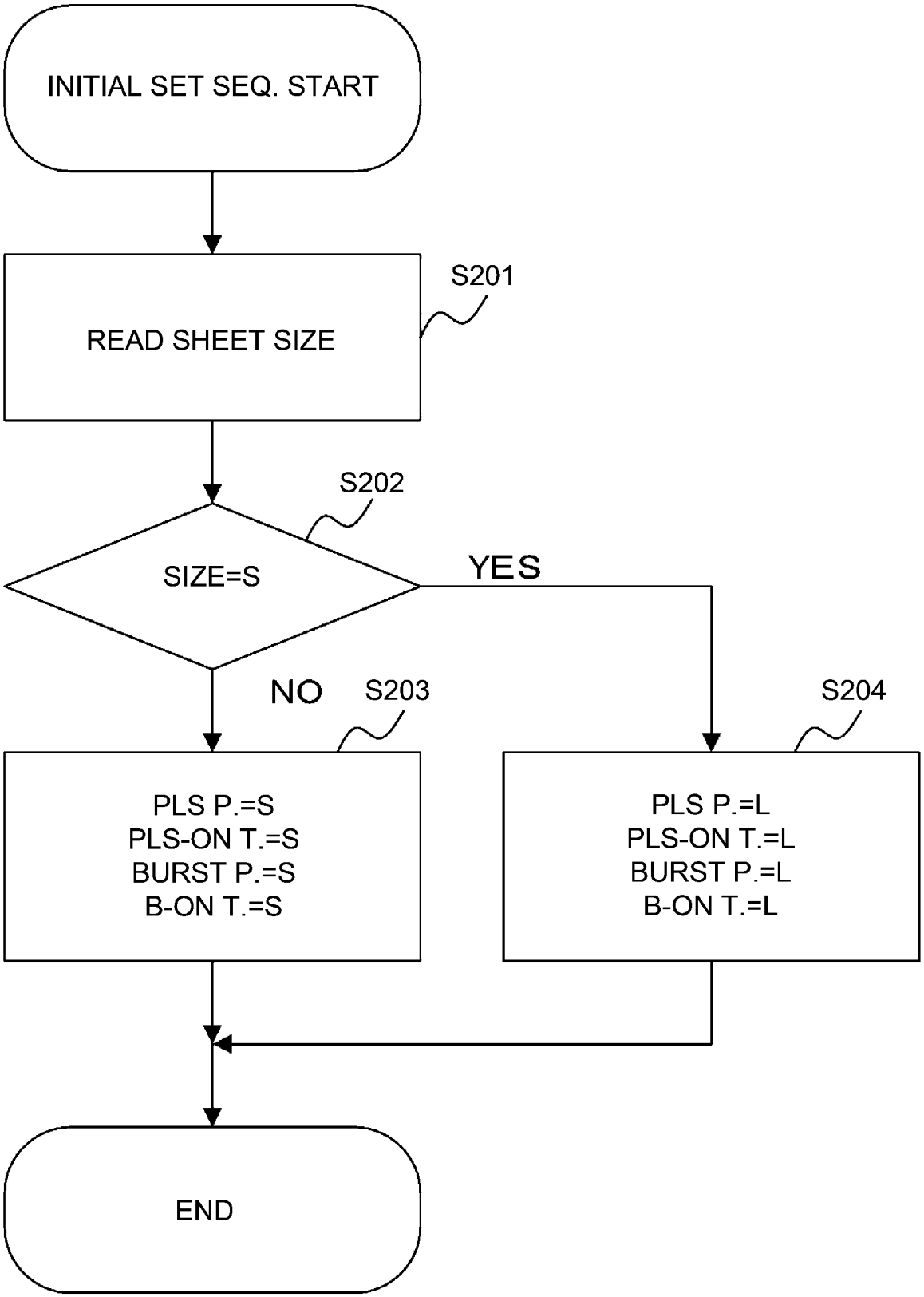

FIG. 16 is a flowchart of the operational sequence for setting values for the control parameters for the high frequency voltage applied to the rotational heating member of the fixing apparatus in the third embodiment.

Figure 17:
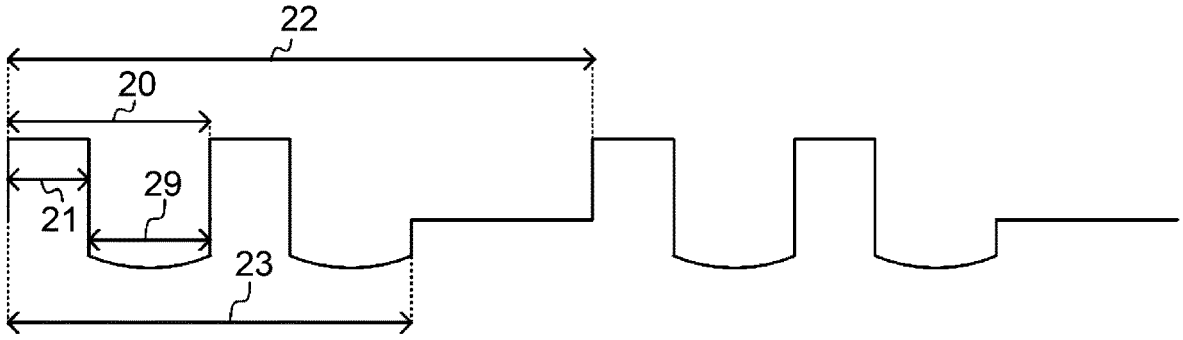

FIG. 17 is a drawing of the waveform of the high frequency voltage outputted by the high frequency converter in a fourth embodiment of the present invention.

Figure 18:
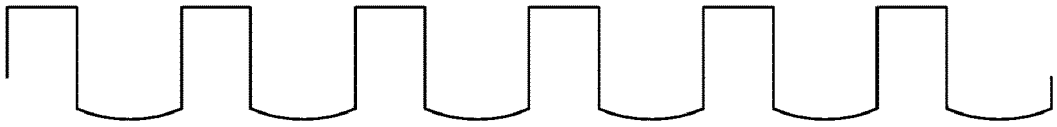
Figure 18:
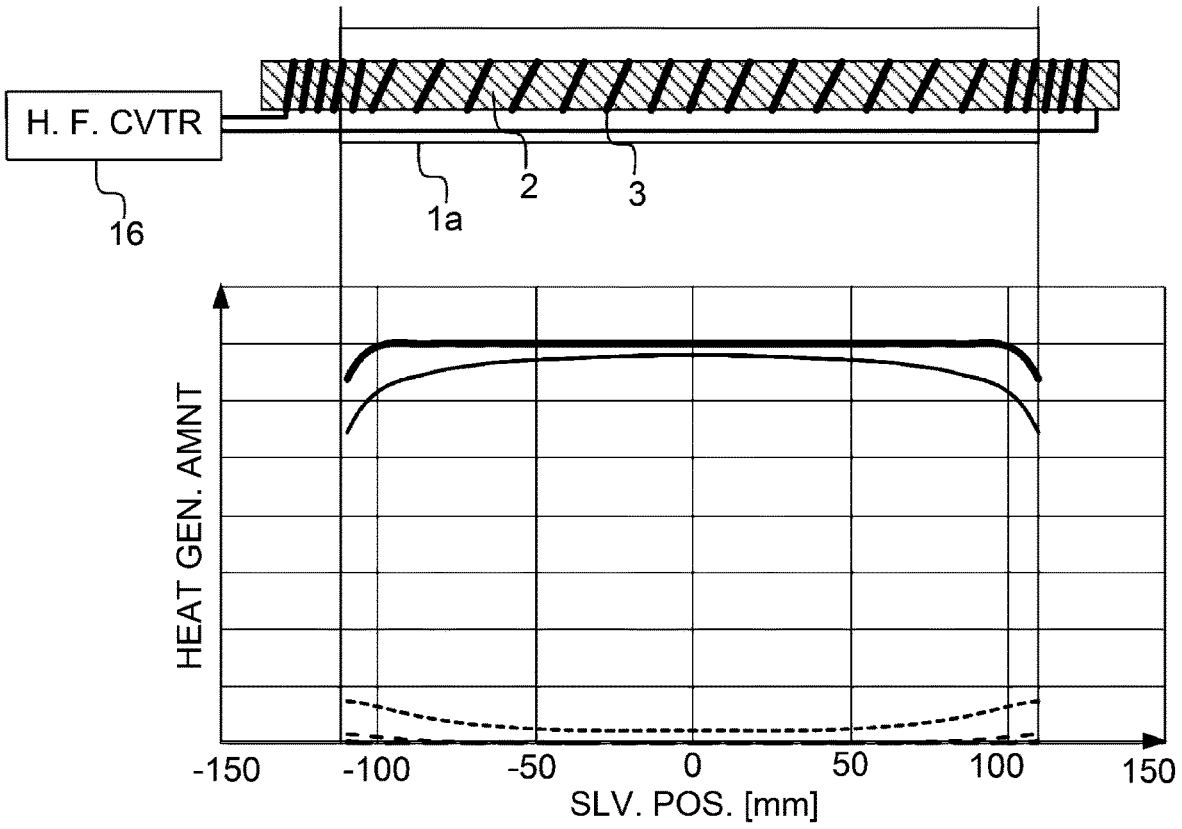

Parts (a)-(b) of FIG. 18 show the relationship between the waveform of the high frequency voltage outputted by the high frequency converter and the heat generation pattern of the rotational heat generating member in the fourth embodiment.

Figure 19:
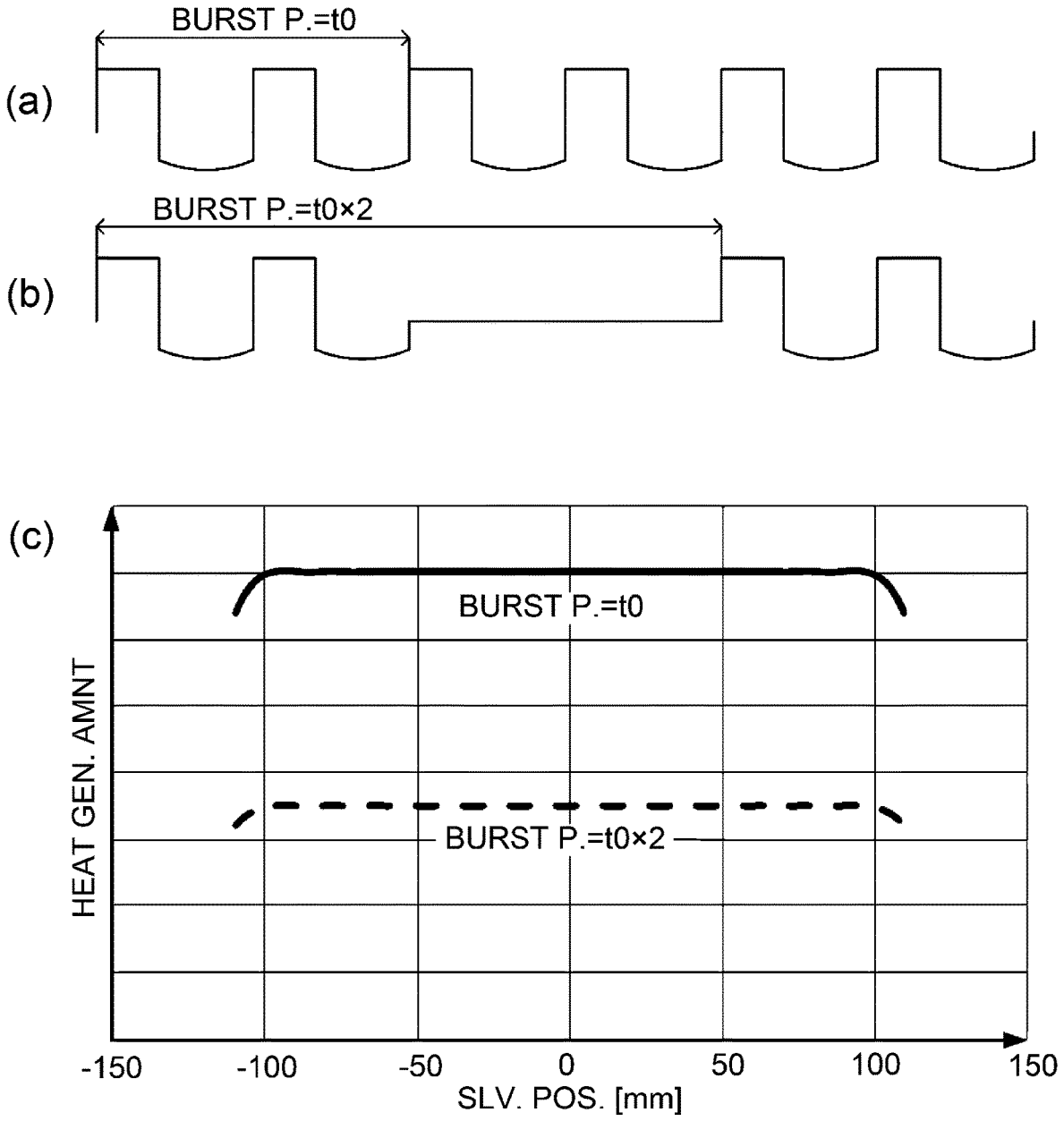

Parts (a)-(c) of FIG. 19 show the temperature control of the rotational heating member of the fixing apparatus in the fourth embodiment.

Figure 20:
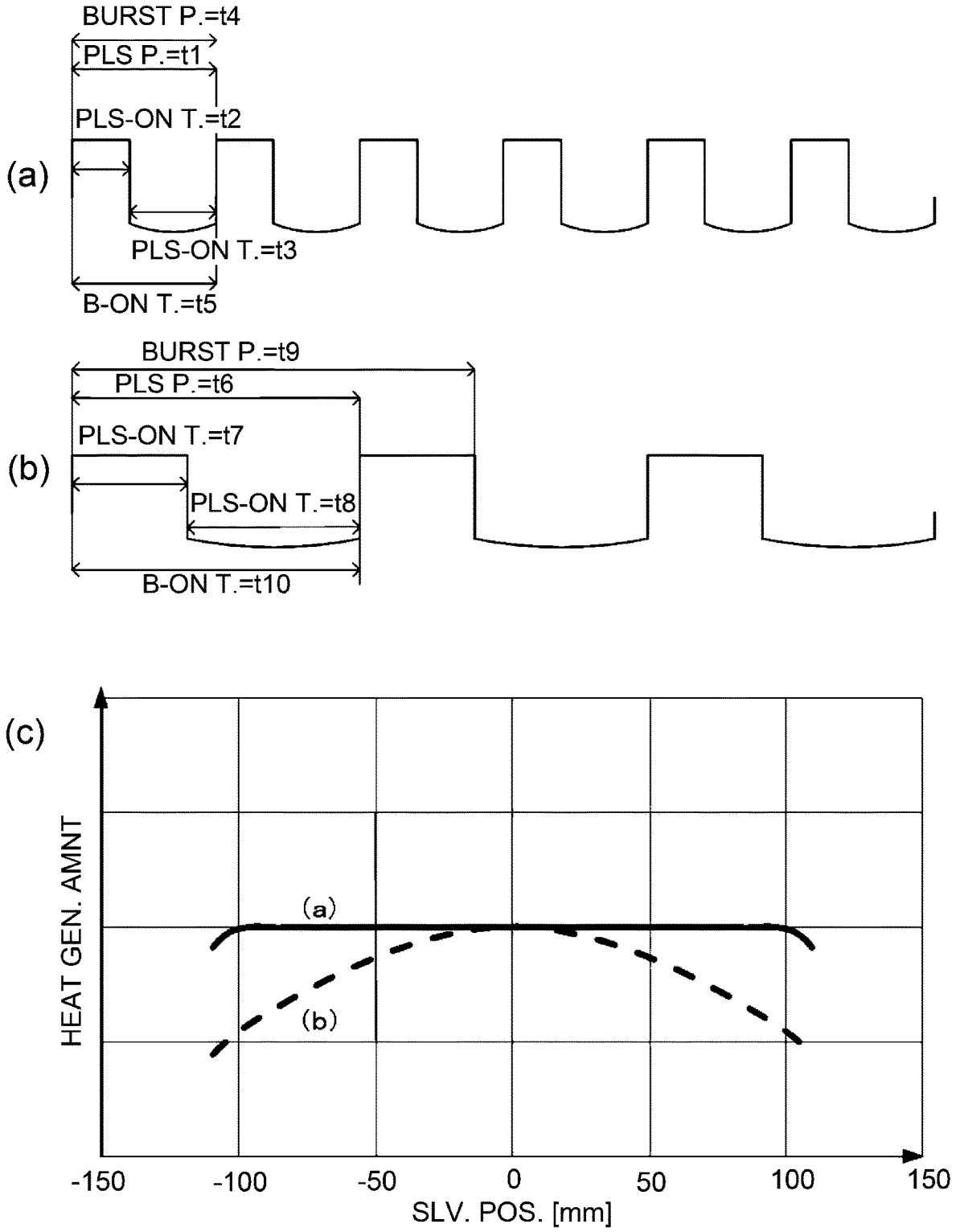

Parts (a)-(c) of FIG. 20 show the control of the heat generation range of the rotational heating member in the forth embodiment.

Figure 21:
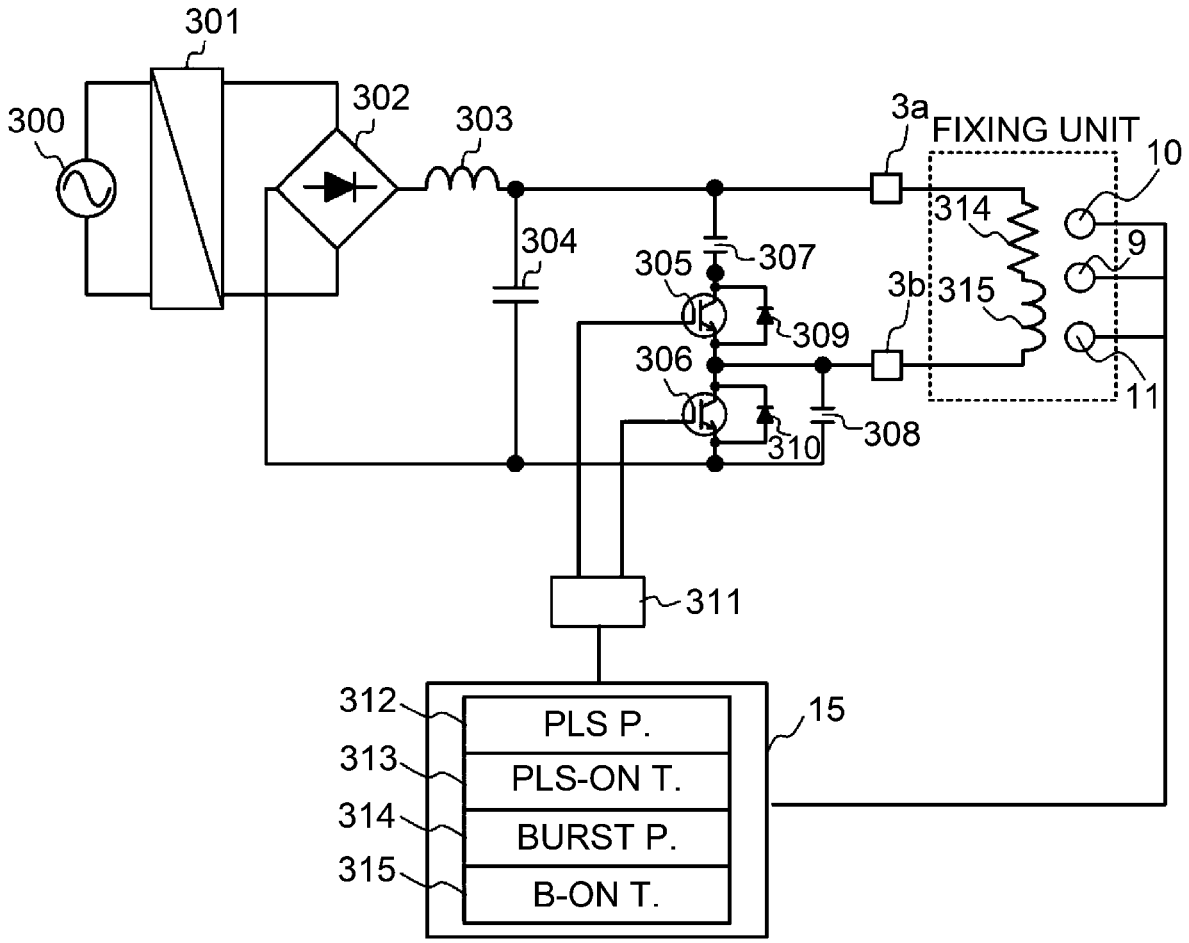

FIG. 21 is a circuit diagram of the high frequency converter in the fourth embodiment.

Figure 22:
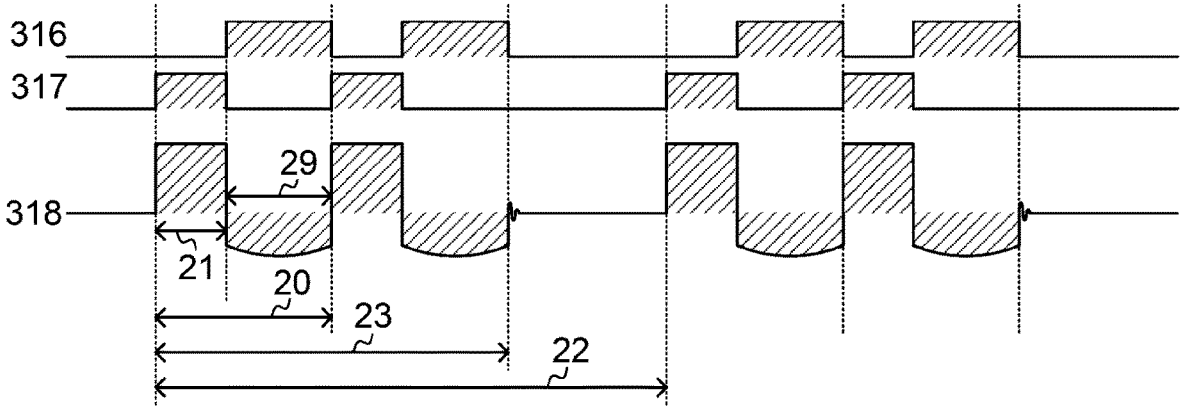

FIG. 22 is a drawing for illustrating the relationship between the waveform of the gate-source voltage of the switching element and the waveform of the high frequency voltage in the fourth embodiment.

DESCRIPTION OF THE EMBODIMENTS

Hereafter, the present invention is described with reference of preferred embodiments of the present invention and appended drawings.

Embodiment 1

(Image Forming Apparatus)

Figure 1:
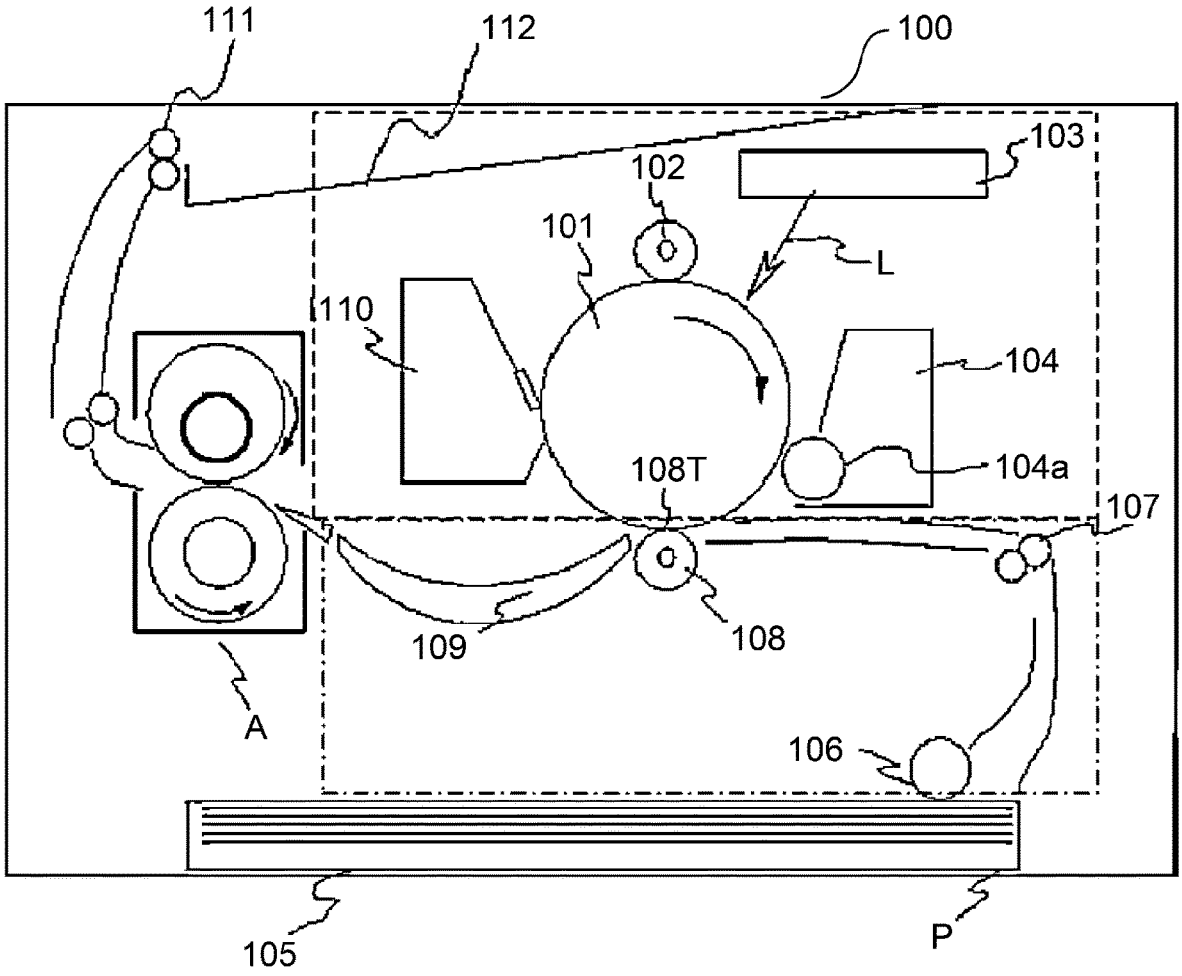
FIG. 1 is a schematic sectional view of the image forming apparatus in a first embodiment of the present invention, which employs a fixing apparatus as an image heating apparatus, as seen from the front side of the image forming apparatus.

FIG. 1 is a schematic sectional view of an image forming apparatus 100 that has the fixing apparatus, as an image heating apparatus, in the first embodiment of the present invention. FIG. 1 shows the general structure of the image forming apparatus 100. The image forming apparatus 100 is a laser beam printer which uses an electrophotographic image formation method. A photosensitive drum 101, as an image bearing member, is rotationally driven in the clockwise direction, as indicated by an arrow mark, at a preset process speed (peripheral velocity). As the photosensitive drum 101 is rotationally driven, the peripheral surface of the photosensitive drum 101 is uniformly charged by a charge roller 102 to a preset polarity and a preset potential level.

A laser beam scanner 103, as an exposing means, exposes the uniformly charged peripheral surface of the photosensitive drum 101 to a beam L of laser light that the laser beam scanner 103 outputs while modulating (turning on or off) the beam L in response to digital image formation signals inputted thereto from an unshown external device, such as a computer. As the uniformly charged peripheral surface of the photosensitive drum 101 is exposed by this laser beam scanner 103, electrical charge is removed from the exposed points of the peripheral surface of the photosensitive drum 101. Consequently, an electrostatic latent image that reflects the information of the image to be formed is formed on the peripheral surface of the photosensitive drum 101.

A developing apparatus 104 has a development roller 104*a* that supplies developer (toner) to the peripheral surface of the photosensitive drum 101. As the peripheral surface of the photosensitive drum 101 is supplied with developer, the electrostatic latent image on the peripheral surface of the photosensitive drum 101 is developed into a visible image formed of toner (which, hereafter, will be referred to as toner image).

A substantial number of sheets P of recording medium are storable, in layers, in a sheet feeder cassette 105. As a feed roller 106 is rotated in response to a signal for starting the feeding of the main assembly of the image forming apparatus 100 with recording medium, the sheets P in the sheet feeder cassette 105 are fed one by one into the main assembly while being separated from the rest in the cassette 105. Then, each sheet P is introduced with a preset timing into a transferring portion 108T, which is the nip between the photosensitive drum 101 and a transfer roller 108, by way of a pair of registration rollers 107. The transfer roller 108 is rotated by the rotation of the photosensitive drum 101. That is, the conveyance of the sheet P is controlled so that the leading edge of the toner image on the photosensitive drum 101, in terms of the rotational direction of the photosensitive drum 101, and the leading edge of the sheet P reach the transferring portion 108T at the same time.

Then, the sheet P of recording medium is conveyed through the transferring portion 108T while remaining pinched between the photosensitive drum 101 and transfer roller 108. While the sheet P is conveyed through the transferring portion 108T, a transfer voltage (transfer bias) is applied to the transfer roller 108 from an unshown transfer bias application power source while being controlled in a preset manner. More specifically, the transfer bias applied to the transfer roller 108 is opposite in polarity from the toner. Thus, the toner image on the peripheral surface of the photosensitive drum 101 is electrostatically transferred onto the surface of the sheet P in the transferring portion 108T.

After the transfer of the toner image I (see FIG. 2) onto the sheet P of recording medium, the sheet P is separated from the peripheral surface of the photosensitive drum 101, is conveyed through a conveyance guide 109, and then, is introduced into a fixing apparatus A. The fixing apparatus A is an image heating apparatus. In the fixing apparatus A, the toner image I is thermally fixed to the sheet P. After the transfer of the toner image I onto the sheet P from the peripheral surface of the photosensitive drum 101, the peripheral surface of the photosensitive drum 101 is cleaned by a cleaning apparatus 110. That is, the residual toner, paper dust, and like contaminants are removed by the cleaning apparatus 110 so that the peripheral surface of the photosensitive drum 101 can be repeatedly used for image formation. After the conveyance of the sheet P through the fixing apparatus A, the sheet P is discharged into a delivery tray 112 through a discharge opening 111.

(Image Heating Apparatus)

Figure 2:
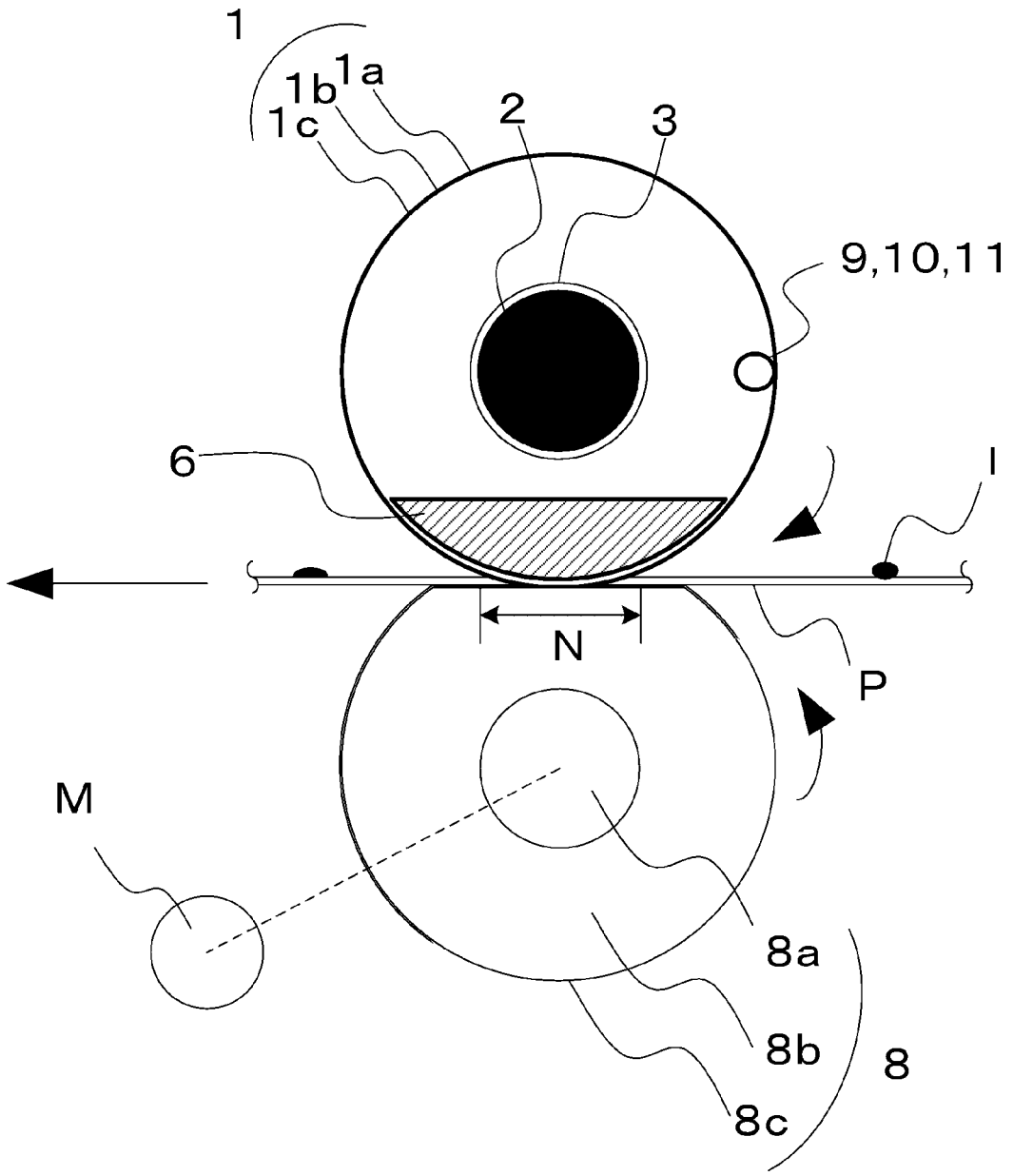
FIG. 2 is a schematic cross-sectional view of a portion of the fixing apparatus in the first embodiment of the present invention.
Figure 3:
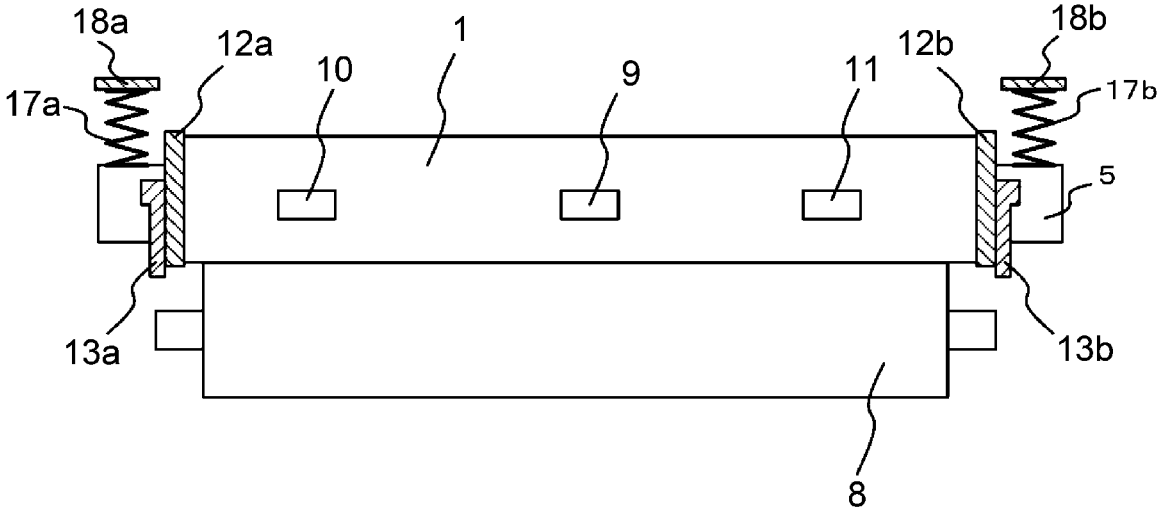
FIG. 3 is a schematic front view of the portion of the fixing apparatus shown in FIG. 2.
Figure 4:
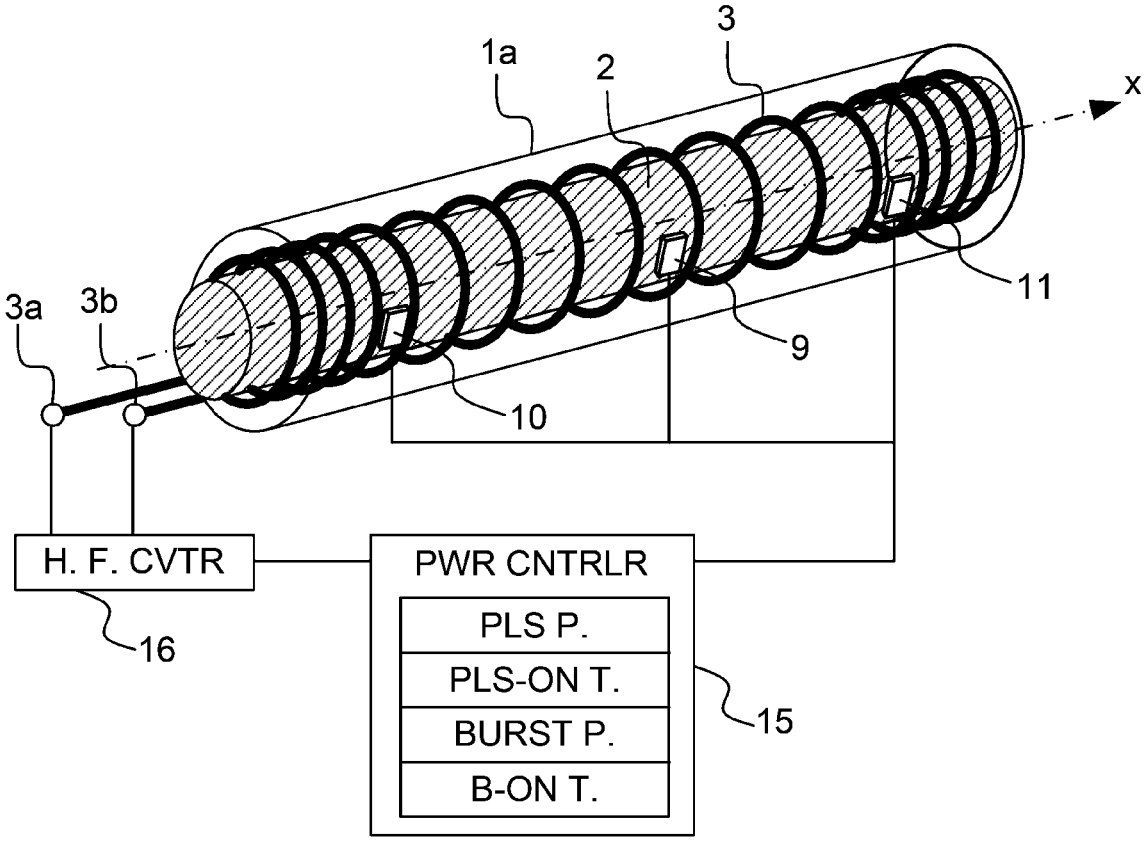
FIG. 4 is a perspective view of the portion of the fixing apparatus shown in FIG. 2.

Next, the fixing apparatus A, as an image heating apparatus, in this embodiment of the present invention is described. The fixing apparatus A uses a heating method based on electromagnetic induction. FIG. 2 is a sectional view of a portion of the fixing apparatus A in this embodiment. FIG. 3 is a front view of the portion of the fixing apparatus A shown in FIG. 2. FIG. 4 is a perspective view of the portion of the fixing apparatus A shown in FIG. 2.

The fixing apparatus A has a cylindrical rotational member 1, a pressure roller 8, and a guiding member 6. The cylindrical rotational member 1 has an electrically conductive layer. The pressure roller 8 is a member which opposes the rotational member 1. The pressure roller 8 is pressed against the guiding member 6, with the placement of the rotational member 1 between the guiding member 6 and pressure roller 8, to form a nip through which a sheet P of recording medium, having a toner image I on one of its surfaces, is conveyed while remaining pinched between the pressure roller 8 and rotational member 1.

Further, the fixing apparatus A has a magnetic field generating having an excitation coil 3 for generating an alternating magnetic field in a direction (indicated by arrow mark in FIG. 4 that is parallel to the rotational axis of the rotational member 1. The magnetic field generating means also has a magnetic core 2 around which the excitation coil 3 is wound. The magnetic field generating means is disposed in the hollow of the rotational member 1. As alternating current is flowed through the excitation coil 3, electrical current is induced in the rotational member 1 in the circumferential direction of the rotational member 1.

Further, the fixing apparatus A has a high frequency converter 16 for applying high frequency voltage to the excitation coil 3. In this embodiment, there are four parameters which are related to length (duration) of time. The values of these four parameters can be changed to control the high frequency voltage output by the high frequency converter 16. These for parameters are pulse cycle duration, pulse duration, burst cycle duration, and burst duration. In this embodiment, temperature of the rotational member 1 is controlled by controlling at least one of the four parameters, based on the output of a temperature detecting means positioned in contact with the center of the inward surface of the rotational member 1 in terms of the lengthwise direction of the rotational member 1. Next, each of the structural members of the fixing apparatus A is described further.

1) Pressure Roller and Related Parts

The pressure roller 8 is a pressure applying member that opposes the rotational member 1. The pressure roller 8 is made up of a metallic core 8*a* and an elastic layer 8*b* formed of a heat-resistant elastic substance, such as silicone rubber, fluorine rubber, and fluorine resin, in a manner to wrap around the metallic core 8*a* so that the axial line of the elastic layer 8*b* coincides with that of the metallic core 8*a*. The pressure roller 8 has also a release layer 8*c* as the surface layer. The elastic layer 8*b* is desired to be formed of such substance as silicone rubber, fluorine rubber, and fluorosilicone rubber that is excellent in heat resistance. The metallic core 8*a* is rotatably supported between the metallic side plates of the unshown chassis of the fixing apparatus A by lengthwise end portions of the metallic core 8*a*. A pair of electrically conductive bearings between the lengthwise end portions of the metallic core 8*a* and the side plates.

Further, the fixing apparatus A is provided with a pair of spring seating members 18*a* and 18*b* (FIG. 3) attached to the chassis, and a pair of compression springs 17*a* and 17*b* (FIG. 3) disposed compressed between the lengthwise end portions of a pressure application stay 5, one for one. Therefore, the pressure application stay 5 remains pressed downward. By the way, in the case of the fixing apparatus A in this embodiment, the total amount of the downward pressure to which the stay 5 is subjected is in a range of roughly 100 N-250 N (roughly 10 kgf-255 kgf).

Therefore, the bottom surface of the guiding member 6 for guiding the cylindrical rotational member 1, which is formed of such heat-resistant resin as PPS, and the upwardly facing portion of the peripheral surface of the pressure roller 8, are pressed against each other, with the cylindrical rotational member 1 sandwiched between the two surfaces. Thus, a fixation nip N, which has a preset width in terms of the recording medium conveyance direction, is formed between the rotational member 1 and pressure roller 8. The guiding member 6 functions, along with the pressure roller 8, as a nip forming member for forming the nip, through which a sheet P of recording medium, which is bearing a toner image I, is conveyed while remaining pinched between the rotational member 1 and pressure roller 8.

As the pressure roller 8 is rotationally driven by a driving means M in the direction indicated by an arrow mark (counterclockwise direction), the rotational member 1 is subjected to rotational force which comes from the friction between the peripheral surface of the rotational member 1 and the peripheral surface of the pressure roller 8. Flanges 12*a* and 12*b* are fitted around the left and right lengthwise end portions of the guiding member 6. They are rotatably attached and are fixed in their position in terms of the left-right direction by a pair of regulating members 13*a* and 13*b*, respectively. They play a role of catching the rotational member 1 by the lengthwise ends of the rotational member 1 as the rotational member 1 rotates in order to control the rotational member 1 in positional deviation in the lengthwise direction of the rotational member 1.

The material for the flanges 12*a* and 12*b* are desired to be one of the following substances: phenol resin, polyimide resin, polyamide resin, polyamide-imide resin, PEEK resin, PES resin, PPS resin, fluorine resin (PFA, PTFE, PEP, etc.), PCP (Liquid Crystal Polymer), and the like, or a mixture of these resins. That is, it is desired to be such a substance that is excellent in heat resistance.

2) Rotational Member 1

The rotational member 1 is 10-50 mm in diameter. The rotational member 1 is cylindrical and multilayer member. The rotational member 1 has a heat generation layer 1*a*, as a substrative layer, formed of an electrically conductive substance. The rotational member 1 also has an elastic layer 1*b* layered on the outward surface of the heat generation layer 1*a* and a release layer 1*c* layered upon the outward surface of the elastic layer. As high frequency voltage is applied to the excitation coil 3, an alternating magnetic flux, that is, a magnetic flux that periodically reverses in polarity, is generated. As the rotational member 1 is subjected to this alternating magnetic flux, eddy current is generated in the heat generation layer 1*a*, causing the heat generation layer 1*a* to generate heat. This heat is transmitted to the elastic layer 1*b* and release layer 1*c*. Consequently, the entirely of the rotational member 1 is heated. Thus, as a sheet P of recording medium, which is bearing a toner image I, is conveyed through the nip N, the sheet P and the toner image I thereon are heated by the rotational member 1. As a result, the toner image I becomes fixed to the sheet P.

The magnetic core 2 is disposed in the hollow of the excitation coil 3 in a manner to extend in the direction (indicated by direction X) that is parallel to the axial line of the rotational member 1. The aforementioned excitation coil 3 is wound around the magnetic core 2. Temperature detection elements 9 and 10 detect the temperature of the rotational member 1.

3) Excitation Coil 3 and High Frequency Converter 16

FIG. 4 is a combination of a perspective view of the combination of excitation coil 3 and magnetic core 2, as a magnetic field generating means for inductively heating the rotational member 1, and a block diagram of a power controlling means for supplying the high frequency converter 16 with electric power. The magnetic core 2 is positioned in the hollow of the rotational member 1 by an unshown fixing means (positioning means) in a manner to extend from one end of the rotational member 1 to the other. The magnetic core 2 guides the magnetic flux of the alternating magnetic field generated by the excitation coil 3 though the inside of the rotational member 1. That is, the magnetic core 2 functions as a member for forming a passage for the magnetic flux.

The excitation coil 3 is formed by spirally winding an ordinary electrically conductive single-strand wire around the magnetic core 2. This strand of electrically conductive wire is wound in such a direction that, as the combination of the excitation coil 3 and magnetic core 2 is placed in the hollow of the rotational member 1, the wire becomes roughly perpendicular to the axial line of the rotational member 1. Therefore, as high frequency voltage is applied to the excitation coil 3 by the high frequency converter 16 through a pair power supply contacts 3*a* and 3*b*, a magnetic flux is generated in the direction which is parallel to the axial line X of the rotational member 1. In this embodiment, by the way, the excitation coil 3 is formed of an electrically conductive single-strand wire. However, this embodiment is not intended to limit the present invention in scope in terms of the electrical wire choice. That is, the present invention is also compatible with an electrically conductive multi-strand wire.

Referring to FIGS. 2-4, the temperature detection elements 9, 10, 11 of the fixing apparatus A are disposed so that they remain in contact with the inward surface of the rotational member 1, on the upstream side of the nip N of the fixing apparatus A in terms of the direction in which a sheet P of recording medium is conveyed to the fixing apparatus A. The temperature of the rotational member 1 of the fixing apparatus A is detected by the first temperature detection element 9 positioned at the center of the rotational member 1 in terms of the lengthwise direction of the rotational member 1, the second temperature detection element 10 positioned at one of the lengthwise end portions of the rotational member 1, and the third temperature detection element 11 positioned at the other lengthwise end portion of the rotational member 1. An unintended excessive temperature increase may occur to portions of the rotational member 1 that are outside the sheet path when a substantial number of small sheets P of recording medium are continuously conveyed for printing. The second and third temperature detection elements 10 and 11 are provided to detect the temperature of the portions of the rotational member 1 that will be outside the path of a small sheet of recording medium in the direction parallel to the rotational axis of the rotational member 1.

In this embodiment, the first temperature detection element 9 is provided to detect the temperature of the portion of the rotational member 1 that is in the recording medium path in terms of the direction parallel to the rotational axis of the rotational member 1 regardless of recording medium size. The power controlling means 15 applies appropriate high frequency voltage to the power supply contacts 3*a* and 3*b* using the high frequency converter in response to the signals from the first temperature detection element 9. Thus, the rotational member 1 is inductively heated in such a manner that its surface temperature is increased to, and maintained at, a preset target level.

Here, the electric power controlling means 15 functions as a controlling means for controlling the high frequency converter 16 as a converter.

Referring to FIG. 8, the electric power controlling means 15 includes a controlling portion 215 for controlling the pulse cycle duration of the high frequency voltage, a controlling portion 216 for controlling the pulse duration of the high frequency voltage, a controlling portion 217 for controlling the burst cycle duration of the high frequency voltage, and a controlling portion 218 for controlling the burst duration of the high frequency voltage. Referring to FIG. 7, the electric power controlling means 15 controls the high frequency converter 16 in power by controlling at least one of the pulse cycle duration 20, pulse duration 21, burst cycle duration 22, and burst duration 23.

The more concrete description of the four parameters is as follows. That is, the pulse cycle duration 20 is the length of time from when a pulse starts up to when the next pulse starts up. The pulse duration 21 is the length, in time, of each pulse. The burst duration 23 is a length of time which is equivalent to n-times the pulse cycle duration (n is integer which is no less than zero). The burst cycle duration 22 is the sum of the burst duration 23 and an optional m-time (m is no less than zero). The burst cycle duration 22 is the length of time it takes for the next burst to start up.

(Description of Waveform of High Frequency Voltage and Method for Controlling High Frequency Voltage)

Part (a) of each of FIGS. 5A and 5B show the waveform of the high frequency voltage, and part (b) of each of FIGS. 5A and 5B show the heat generation pattern of the cylindrical rotational member 1. The method for controlling the cylindrical rotational member 1 in the heat generation pattern in terms of the lengthwise direction of the rotational member 1 will be described with reference to parts (a) and (b) of FIGS. 5A and 5B. Part (a) of FIG. 5A shows the waveforms (sinusoidal) of the high frequency voltages (90 kHz, 270 kHz, 450 kHz, 630 kHz and 810 kHz in frequency) applied between the power supply contacts 3*a* and 3*b* from the high frequency converter 16. Part (b) of FIG. 5A shows the heat generation pattern of the rotational member 1 when the high frequency voltages, shown in part (a) of FIG. 5A, which are sinusoidal in waveform, are applied between the power supply contact points 3*a* and 3*b* from the high frequency converter 16.

Here, the heat generation layer 1*a* of the rotational member 1 is formed of stainless steel. The heat generation layer 1*a* is 30 μm in thickness, 30 mm in diameter, and 220 mm in length. The magnetic core 2 is formed of ferrite. The magnetic core 2 is 12 mm in diameter and 270 mm in length. The excitation coil 3 is formed of a piece of electrically conductive single-strand wire. It is wound around the magnetic core 2 at such a pitch that the lengthwise end portions are high in density, and the center portion is low in density.

Part (a) of FIG. 5B shows the high frequency voltages which are to be applied between the power supply contact points 3*a* and 3*b* from the high frequency converter 16, and which are rectangular in waveform. Part (a) of FIG. 5B shows harmonic components, as well, which are obtainable by Fourier transformation. Part (b) of FIG. 5B shows the heat generation pattern of the cylindrical rotational member 1 when the high frequency voltage, shown in part (a) of FIG. 5B, which is rectangular in waveform, is applied between the power supply contact points 3*a* and 3*b* from the high frequency converter 16. Part (b) of FIG. 5B is the same as part (b) of FIG. 5A in the positioning of heat generation layer 1*a*, magnetic core 2, and excitation coil 3.

In a case when the high frequency voltage, shown in part (a) of FIG. 5A, which is sinusoidal in waveform, and 90 kHz in frequency, is applied between the power supply contact points 3*a* and 3*b*, the heat generation pattern is such that it is low across the lengthwise end portions of the rotational member 1, and high across the center portion of the rotational member 1, as indicated by a solid line in part (b) of FIG. 5A. On the other hand, in a case when high frequency voltages, shown in part (a) of FIG. 5A, which are sinusoidal in waveform, and 270 kHz, 450 kHz, 630 kHz and 810 kHz in frequency, are applied between the power supply contact points 3*a* and 3*b*, the heat generation pattern of the rotational member 1 is such that it is high across the end portions of the rotational member 1, and low across the center portion, as shown in part (b) of FIG. 5A. The higher the high frequency voltage in frequency, the more conspicuous this tendency is.

Next, a case in which the high frequency voltage, shown in part (a) of FIG. 5B, which is rectangular in waveform, is applied between the power supply contact points 3*a* and 3*b* is described. First, referring to FIG. 6, high frequency voltage which has an ordinary waveform is described. The high frequency voltage shown in FIG. 6 is A in amplitude, T in pulse cycle duration, and Tp in pulse duration. Further, there is the following relationship between T and Tp: T/2: Tp=1: P (0<P<1). A high frequency voltage which has such a waveform as the above-described one can be expressed in the form of the following time function by Fourier series development.

$$V(t) = \sum_{m=1}^{\infty}\left[\frac{4A(-1)^{m+1}}{(2m-1)\pi}\cdot\sin\frac{(2m-1)P\pi}{2}\cdot\sin\frac{(2m-1)\cdot 2\pi}{T}t\right] = \frac{4A}{\pi}\cdot\sin\frac{P\pi}{2}\cdot\sin\frac{2\pi}{2}t - \frac{4A}{3\pi}\cdot\sin\frac{3P\pi}{2}\cdot\sin\frac{3\cdot 2\pi}{T}t + \frac{4A}{5\pi}\cdot\sin\frac{5P\pi}{2}\cdot\sin\frac{5\cdot 2\pi}{T}t - \frac{4A}{7\pi}\cdot\sin\frac{7P\pi}{2}\cdot\sin\frac{7\cdot 2\pi}{T}t + \frac{4A}{9\pi}\cdot\sin\frac{9P\pi}{2}\cdot\sin\frac{9\cdot 2\pi}{T}t - \ldots \quad (1)$$

Based on this Formula (1), the high frequency voltage which is rectangular in waveform can be divided into the first, third, fifth, seventh, and ninth members, and so on. Here, the first, third, fifth, seventh, and ninth members correspond to the high frequency voltages, which are sinusoidal in waveform and are 270 kHz, 450 kHz, 630 kHz and 810 kHz, respectively, in frequency, are different from those shown in part (a) of FIG. 5A only in the amplitude of the waveform. Therefore, as the constant of each term is taken into consideration, the heat generation pattern of the rotational member 1 becomes those which correspond to first-ninth terms, respectively, as shown in part (b) of FIG. 5B.

As for the heat generation pattern of the rotational member 1, which corresponds to the rectangular waveform, it is an integration of all the terms. Thus, it is possible to make the rotational member 1 roughly evenly generate heat across a desired range of the rotational member 1 in terms of the lengthwise direction of the rotational member 1. In this embodiment, the high frequency converter 16 is adjusted in the pulse cycle duration and pulse duration of the high frequency voltage, which is rectangular in waveform, and the pitch of coil 3 in order to make the rotational member 1 roughly evenly generate heat across a desired range in terms of the lengthwise direction of the rotational member 1.

(High Frequency Converter)

Next, referring to FIG. 8, the structure of the high frequency converter 16 is described. Reference numeral 200 stands for a commercial AC power source. Reference numeral 201 stands for a filter. Reference numeral 202 stands for a diode bridge. Reference numeral 204 stands for a coil. Reference numeral 205 stands for a condenser. Reference numerals 206, 207, 208 and 209 stand for switching elements. Reference numerals 210, 211, 212 and 213 stand for condensers. Reference numeral 219 stands for an equivalent resistance as seen from the direction of the power supply contact points 3*a* and 3*b* of the fixing apparatus A. Reference numeral 220 stands for an equivalent inductance as seen from the direction of the power supply contact points 3*a* and 3*b*. Reference numeral 214 stands for a driver circuit which turns on and off the switching elements 206-209 to generate high frequency voltage which has a desired waveform.

As AC voltage is inputted from the commercial power source 200, it is rectified by the diode bridge 202 and is stored in the condenser 205 by way of the coil 204. The coil 204 prevents the occurrence of abrupt current change. The capacity of the condenser 205 only has to be large enough to suppress the noises which are generated as the switching elements 206-209 are turned on and off, for the following reason. That is, if a condenser which is large in capacity is employed, the high frequency converter 16 is reduced in power factor. Thus, as electric power is consumed by the circuits which are on the downstream side of the condenser 205, the voltage between the two terminals of the condenser 205 becomes pulsative.

Next, referring to FIG. 9, the control operation of the switching elements 206-209, which are parts of the high frequency converter 16, are described. Reference numeral 221 stands for a gate-source voltage of the switching element 206. Reference numeral 222 stands for gate-source voltage of the switching element 207. Reference numeral 223 stands for gate-source voltage of the switching element 208. Reference numeral 224 stands for gate-source voltage of the switching element 209. Reference numeral 225 stands for the high frequency voltage to be applied between the power supply contact points 3*a* and 3*b*.

The hatched portions in FIG. 9 correspond to the period in which the switching elements 206 and 209 are on, or the switching elements 207 and 208 are on, and therefore, voltage is being applied between the power supply contact points 3*a* and 3*b*. The hatched portions in FIG. 9 correspond to the pulse duration 21.

The gate-source voltage 221 of the switching element 206, gate-source voltage 222 of the switching element 207, gate-source voltage 223 of the switching element 208, and gate-source voltage 224 of the switching element 209 are the same in waveform and are different only in phase. The pulse duration 21 can be controlled by controlling this phase period.

The period between when the gate-source voltage 221 and gate-source voltage 223 start up and when they start next time and the period between when the gate-source voltage 222 and gate-source voltage 224 begin to fall and when they begin to fall next time correspond to the pulse duration 20. The high frequency converter 16 can be controlled in the pulse duration 20 by controlling this period.

Referring to FIG. 9, the period in which the pulses of the gate-source voltage 221-224 are continuous corresponds to the burst duration 23. The high frequency converter 16 can be controlled by controlling this period. Further, the sum of the period in which the pulse of the gate-source voltages 221-224, shown in FIG. 9, are continuous, and the period in which they are off, corresponds to the burst cycle duration 22. The high frequency converter 16 can be controlled in burst cycle duration 22 by controlling this period.

(Temperature Control of Rotational Member 1)

Parts (a)-(e) of FIG. 10 show the temperature control in this embodiment. The pulse duration 21 among the control parameters in FIG. 7 is used for the temperature control. Part (e) of FIG. 10 shows the heat generation patterns of the sleeve, as the rotational member 1, in terms of the lengthwise direction of the rotational member 1. Part (a) of FIG. 10 corresponds to a case in which the rotational member 1 is roughly uniform in the amount of heat generation across its heat generation range, as indicated by a solid line in part (e) of FIG. 10. It shows the waveform of the high frequency voltage when the rotational member 1 is largest in the amount of heat generation. Referring to part (a) of FIG. 10, the pulse duration 21 is 5.0E-6 seconds, pulse cycle duration 20, 11.1E-6 second (90 kHz), and both the burst cycle duration 22 and burst duration 23 are 11.1E-6 seconds.

Part (b) of FIG. 10 shows the waveform of the high frequency voltage when the amount of heat generation of the rotational member 1 is ⅔ of the maximum amount of the heat generation, as indicated by a dotted line in part (e) of FIG. 10, which shows the heat generation patterns of the rotational member 1. In this case, the pulse cycle duration 20, burst cycle duration 22, and burst duration 23 are the same as those in part (a) of FIG. 10, and the pulse duration 21 is reduced to 3.3E-6 seconds. This is how the rotational member 1 is controlled in temperature.

Next, referring to part (c) of FIG. 10, as the pulse duration 21 is further reduced to 2.2E-6 seconds while leaving the pulse cycle duration 20, burst cycle duration 22, and burst duration 23 as they are, the heat generation pattern of the rotational member 1 becomes as indicated by a single-dot chain line in part (e) of FIG. 10. That is, the amount by which heat is generated across the lengthwise end portions of the rotational member 1 in terms of the lengthwise direction of the rotational member 1 becomes slightly larger, for the following reason. That is, as the pulse duration 21 is reduced, the terms in Formula (1), which are higher in order, become greater in the value of their constant, compared to the first term. Thus, the rotational member 1 changes in the heat generation pattern in such a manner that the lengthwise end portions of the rotational member 1 become greater in the amount of heat generation than the center portion.

However, the effect of the reduction of the pulse duration 21 to 2.2E-6 seconds, that is, the effect that the lengthwise end portions of the rotational member 1 become higher in the amount of heat generation than the center portion, can be mitigated, as indicated by a fine solid line in part (e) of FIG. 10 by the lengthening of the pulse cycle duration 20 (=burst cycle duration 22=burst duration 23) to 12.5E-6 seconds. That is, the rotational member 1 can be made roughly uniform in the amount of heat generation across its heat generation range, as indicated by a fine solid line in part (d) of FIG. 10, by extending the pulse cycle duration 20 (=burst cycle duration 22=burst duration 23) to 12.5E-6 seconds.

In the preceding description of this embodiment, it was assumed that the burst cycle duration 22 and burst duration 23 were not changed. Actually, however, the foregoing description is also true with a case in which the high frequency voltage is not controlled in burst. That is, this embodiment is also compatible with a fixing apparatus which does not have a function to control the burst cycle duration 22 and burst duration 23. In such a case, the high frequency converter 16 is controlled in the pulse duration 21 according to the value detected by the temperature detection element 9, as described above, and the initial value for the parameter for the pulse cycle duration 20 is set to control the rotational member 1 in the width of the heat generation area, according to recording medium width.

By the way, in the foregoing description of this embodiment, an example of the driver circuit and an example of the method for controlling the high frequency converter 16 described with reference to a circuit of the full bridge type. One of the effects of the employment of a full bridge circuit is that a full bridge circuit is higher in power source efficiency. However, any combination of driver circuit and control method is acceptable, as long as the combination can generate such high frequency voltage as the one shown in FIG. 7, which alternates in polarity between the positive and negative sides, and which is the same in waveform on the positive and negative sides and control the high frequency voltage. That is, the compatibility of this embodiment is not limited to a circuit of the full bride type. That is, the compatibility of this embodiment is not limited to those which output such high frequency voltage that alternates in polarity between the positive and negative sides, and the positive and negative sides are the same in waveform. That is, this embodiment is also compatible with such a high frequency converter that is equipped with a circuit of the active clamp type and outputs such high frequency voltage that alternates in polarity between the positive and negative sides, and its waveform is such that the positive and negative sides are different in shape.

As described above, according to this embodiment, the fixing apparatus A, as an image heating apparatus, is structured so that the excitation coil 3 is disposed in the hollow of the rotational member 1, and high frequency voltage is applied to the excitation coil 3 to generate an alternating magnetic field in the direction parallel to the rotational axis of the rotational member 1, in order to make the rotational member 1 generate heat. Therefore, it is possible to provide a fixing apparatus which is simpler in structure than any conventional fixing apparatus of the electromagnetic induction type, and yet, can supply heat by a proper amount necessary for fixation, while providing the rotational heating member with a heat generation pattern which is in accordance with recording medium size in terms of the widthwise direction of the recording medium.

In this embodiment, the rotational member is controlled in temperature by the control of two among the four control parameters, more specifically, pulse cycle duration 20, pulse duration 21, burst cycle duration 22, and burst duration 23, by the electric power controlling means 15 for controlling the high frequency converter 16. This embodiment, however, is not intended to limit the present invention in scope in terms of the control of the high frequency converter 16. For example, the present invention is also applicable to a fixing apparatus designed so that the means for controlling the high frequency converter uses three or more, or only one, of the aforementioned four control parameters.

Embodiment 2

In the foregoing, the first embodiment was described with reference to a case in which an image forming apparatus (fixing apparatus) can accommodate only one type of sheet of recording medium in terms of width. That is, the control of the rotational member 1 in terms of heat generation pattern was described with reference to a sheet P of recording medium of a preset size. In the second embodiment, the fixing apparatus A is structured so that the heat generation range of the heat generation pattern of the rotational member 1 (heat generating member) is controlled according to recording medium size (width).

The temperature controlling method and high frequency converter in this embodiment are the same as those in the first embodiment. That is, also in this embodiment, the temperature of the rotational member 1 is controlled by the controlling of no less than one among the aforementioned four control parameters, by the electric power controlling means 15, based on the output of the first temperature detecting means 9.

Next, referring to parts (a)-(d) of FIG. 11, the control of the heat generation pattern of the rotational member 1, in this embodiment, is described. In this embodiment, it is assumed that the pulse cycle duration 20, burst cycle duration 22, and burst duration 23 among the four control parameters, are the same in length. The high frequency converter 16 is designed so that it is controllable in the pulse cycle duration 20 and pulse duration 21.

Part (a) of FIG. 11 shows the waveforms of the high frequency voltages when the rotational member 1 is roughly uniform in the amount of heat generation in terms of its lengthwise direction, as indicated by a solid line in part (d) of FIG. 11. In this case, the pulse cycle duration 20, burst cycle duration 22, and burst duration 23 are the same in value (3.3E-6 seconds (90 kHz)), and the pulse duration 21 is 3.3E-6 seconds. In this embodiment, the burst duration 23 is the same as pulse cycle duration 20 (aforementioned n is 1), and the burst cycle duration 22 is the same in value as the burst duration 23 (aforementioned m is 0).

Part (b) of FIG. 11 shows the waveform of the high frequency voltage when the heat generation pattern of the rotational member 1 is such that its center portion of the rotational member 1 is greater in the amount of heat generation. In Part (b) of FIG. 11, however, amount of heat generation of center portion is less than in a case in which waveform is as shown in part (a) of FIG. 11. In this case, the pulse duration 21 is the same as the one shown in part (a) of FIG. 11. The high frequency converter 16 can be controlled so that the heat generation pattern of the rotational member 1 becomes such that the center portion of the rotational member 1 is greater in the amount of heat generation than the lengthwise end portions, by keeping the pulse duration 21 the same as the one in part (a) of FIG. 11, and extending the pulse cycle duration 20, burst cycle duration 22, and burst duration 23 to 16.7E-6 seconds (60 kHz).

Part (c) of FIG. 11 shows the waveform of the high frequency voltage when the heat generation pattern of the rotational member 1 in terms of the lengthwise direction of the rotational member 1 is such that the center portion of the rotational member 1 is greater in the amount of heat generation than the lengthwise end portions, as indicated by the dotted line in part (d) of FIG. 11, which shows the heat generation pattern of the rotational member 1. Here, the pulse cycle duration 20, burst cycle duration 22, and burst duration 23 are the same as those in part (b) of FIG. 11. In this case, the high frequency converter 16 can be controlled so that it increases in the amount of heat generation, by extending the pulse duration 21 to 4.2E-6 seconds, as shown in part (c) of FIG. 11, so that the value of the temperature detected by the temperature detection element 9 becomes the same as the preset one.

With the high frequency converter 16 being set up as described above, the heat generation pattern of the rotational member 1 can be controlled according to the size of a sheet P of recording medium which is being used. That is, in a case when a wider sheet P of recording medium is used, the rotational member 1 can be controlled in heat generation pattern as indicated by a solid line in part (d) of FIG. 11, whereas in a case when a smaller sheet P of recording medium is used, the rotational member 1 can be adjusted in heat generation pattern as indicated by the broken line, or single-dot chain line, in part (d) of FIG. 11.

In this embodiment, the amount of heat generation and heat generation pattern of the rotational member can be controlled by controlling the two of the four control parameters for the high frequency converter 16, more specifically, the pulse cycle duration 20 and pulse duration 21, as described above. Therefore, the overall amount of heat generation of the rotation al member 1 can be controlled according to the temperature detected by the temperature detection element 9.

Next, referring to the flowchart in FIG. 12, the procedure for setting the pulse cycle duration 20, burst cycle duration 22, and burst duration 23 to control the rotational member 1 in its heat generation range is described. Here, the procedure is described with reference to two types of recording medium sheets, which are different in size. Here a sheet P of recording medium of size A4 is used as recording medium of a large size, and a sheet P of recording medium of size B5 is used as recording medium of a smaller size.

As a sheet P of recording medium of size A4, that is, a large sheet of recording medium, is selected by an unshown print signal, an operational sequence, shown in FIG. 12, for setting initial values for the parameters is started. First, the recording medium size (A4) is read in Step S101. Next, it is determined in Step 102 whether or not the sheet P is small (=B4) in size. Here, the sheet size is A4, and therefore, the answer is "No" (=large size). Thus, Step S103 is taken as the next step.

In Step S103, the pulse cycle duration 20, burst cycle duration 22, and burst duration 23 are set to short S. Here, the pulse cycle duration 20, burst cycle duration 22, and burst duration 23 are set to 11.1E-6 seconds (90 kHz), as described with reference to FIG. 11, ending the sequence for setting initial values for the parameters.

On the other hand, as a sheet of recording medium, which is smaller in size than A4, is selected as recording medium by the unshown print signal, the operational sequence, shown in FIG. 12, for setting the initial values for the parameters is started. First, the recording medium size, which is B5 in this case, is read in Step 101. Next, whether or not the recording medium is of the small size (=B5) is determined in Step 102. Here, the recording medium size is B5. Therefore, the answer is "Yes". Therefore, Step S104 is taken.

In Step S104, the pulse cycle duration 20, burst cycle duration 22, and burst duration 23 are set to be long L. In this embodiment, the pulse cycle duration 20, burst cycle duration 22, and burst duration 23 are set to 16.7E-6 seconds (60 kHz) for size B5, which is smaller than size A4, as shown in part (b) of FIG. 11 or 11(*c*), ending the sequence for setting initial values for the parameters.

Although the sequence was described with reference to two types of sheet of recording medium, which are different in size, this embodiment is not intended to limit the present invention in scope in terms of the size of the recording medium usable with an image forming apparatus which is in accordance with the present invention. That is, in a case when the present invention is applied to an image forming apparatus which is capable of handling three or more types of sheet, which are different in size, all that occurs is that the sequence increases in the number of steps, which are similar to those in FIG. 12. It is after the completion of this sequence that the fixing apparatus A is controlled for actual fixation.

As described above, according to this embodiment, it is possible to provide a fixing apparatus which is simpler in structure than any conventional image heating apparatus of the electromagnetic induction type, and yet, can generate heat by an amount necessary for proper fixation, while causing its rotational heating member 1 to generate heat in such a pattern that matches the size of recording medium, even in a case when two or more types of sheet of recording medium, which are different in size, are used for an image forming operation.

In this embodiment, at least one of the four control parameters is specifically set based on the recording medium size in terms of the widthwise direction of the recording medium to control the heat generation pattern of the rotational member 1 in terms of the direction parallel to the axial line of the rotational member 1. This embodiment, however, is not intended to limit the scope present invention in scope in how the heat generation pattern of the rotational member 1 is controlled. For example, the present invention is also applicable to an image forming apparatus designed so that the pattern of heat generation, in terms of its lengthwise direction, of the rotational member 1 is controlled by controlling at least one of the aforementioned four control parameters (duration), based on the output of the temperature detecting means disposed in contact with the inward surface of one of lengthwise end portions of the rotational member 1. In a case when the recoding medium used for image formation is small in size in terms of the widthwise direction of the recording medium, the temperature detecting means disposed in contact with the inward surface of one of the lengthwise end portions of the rotational member 1 increases in its output. Therefore, the rotational member 1 is adjusted in the pattern of heat generation, based on this increased output of the temperature detecting means to deal with recording medium of the small size.

Embodiment 3

This embodiment is also related to a case in which an image forming apparatus, and its fixing apparatus, are enabled to deal with two or more types of recording medium, which are different in size, like in the second embodiment. As far as the method for controlling the rotational member 1 in temperature, and the method for controlling the high frequency converter in its high frequency voltage output, are concerned, the third embodiment is the same as the first one. That is, the electric power controlling means 15 controls the temperature of the rotational member 1 by controlling at least one (burst cycle duration 22, in reality) of the aforementioned four control parameters, based on the output of the first temperature detecting means disposed in contact with the inward surface of the center of the rotational member 1 in terms of the lengthwise direction of the rotational member 1.

In this embodiment, all of the four control parameters shown in FIG. 7 are used to control the rotational member 1 in heat generation pattern in terms of its lengthwise direction. In reality, it is assumed that the pulse cycle duration 20, burst cycle duration 22, and burst duration 23 are the same in length, and the high frequency converter 16 is adjusted in pulse cycle duration and pulse duration.

1) Temperature Control of Rotational Member 1

Parts (a)-(c) of FIG. 13 show the temperature control of the rotational member 1 in this embodiment. In this embodiment, the rotational member 1 is controlled in temperature with the use of the burst cycle duration 22 among the control parameters in FIG. 7. Part (a) of FIG. 13 shows the waveform of the high frequency voltage when the rotational member 1 is roughly uniform in the amount of heat generation, and is maximum in the amount of heat generation, as indicated by a solid line in part (c) of FIG. 13. In part (a) of FIG. 13, the burst cycle duration 22 is 22.2E-6 seconds; burst duration 23, 22.2E-6 seconds; pulse cycle duration 20, 11.1E-6 seconds (90 kHz); and pulse duration 21 is 5.0E-6 seconds.

Part (b) of FIG. 13 shows the waveform of the high frequency voltage when the amount of heat generation of the rotational member 1 is ½ the maximum amount of heat generation of the rotational member 1 as indicated by a broken line in part (c) of FIG. 13. The pulse cycle duration 20 and pulse duration 21, and burst duration 23 in part (b) of FIG. 13 are the same as those in part (a) of FIG. 13, whereas the burst cycle duration 22 is 44.4E-6 seconds, being longer than the counterpart in part (a) of FIG. 13.

Here, the method, in this embodiment, for finely adjusting the amount of heat generation across the heat generation range of the rotational member 1 by the adjustment of the burst cycle duration 22 is described. Part (a) of FIG. 14 shows the power spectrum when the high frequency voltage which has the waveform shown in part (a) of FIG. 13 was applied to the rotational member 1. Reference numeral 24 stands for the fundamental frequency of the high frequency voltage, in the pulse cycle duration 20, and reference numeral 25 stands for the harmonic frequency of the high frequency voltage, in pulse cycle duration 20, in the rectangular wave. Part (b) of FIG. 14 shows the power spectrum when the high frequency voltage that has the waveform shown in part (b) of FIG. 13 was applied to the rotational member 1. Reference numeral 24 stands for the fundamental frequency in the pulse cycle duration 20, and reference numeral 25 stands for the harmonic frequencies in the pulse cycle duration 20 in the rectangular wave. Reference numeral 26 stands for the fundamental frequency in the burst cycle duration 22, and reference numeral 27 stands for the harmonic frequencies in the burst cycle duration 22.

Referring to parts (a)-(c) of FIG. 13, the rotational member 1 can be controlled in temperature, while being left uniform in the amount of heat generation across its heat generation range, by lengthening the burst cycle duration 22. In reality, however, lengthening the burst cycle duration 22, causes the high frequency converter 16 to output such high frequency voltage that has power components which are attributable to the burst cycle duration 22 which is shorter than the pulse cycle duration 20, as shown in Parts (a) and (b) of FIG. 14. Referring to FIG. 7, in a case when the burst cycle duration 22 and pulse cycle duration 20 are close to each other in value, the power component attributable to the burst cycle duration 22 is small, being therefore small in its effect upon the heat generation pattern of the rotational member 1. Therefore, it is possible to control the rotational member 1 in temperature while keeping the rotational member 1 roughly uniform in temperature.

On the other hand, as the difference between the burst cycle duration 22 and pulse cycle duration 20 increases to a certain degree, the power component attributable to the burst cycle duration 22, which is lower in frequency, increases. Therefore, the heat generation pattern of the rotational member 1 becomes such that the center portion of the rotational member 1 is slightly higher in the amount of heat generation than the lengthwise end portions of the rotational member 1.

In such a case, the amount of heat generation across the heat generation range of the rotational member 1 can be kept roughly uniform by increasing the harmonic frequency of the pulse cycle duration 20 in the rectangular wave to prevent the heat generation pattern of the rotational member 1 from becoming such that its center portion is slightly higher in the amount of heat generation than its lengthwise end portion. In reality, however, the rotational member 1 is finely adjusted in the amount of heat generation across its heat generation range by controlling the burst duration 23 according to the values detected by the second and third temperature detection elements 10 and 11, respectively, which are provided to detect the temperature of the lengthwise end portions of the rotational member 1. Similarly, the power spectrum components can be controlled by controlling the burst duration 23 of the high frequency converter 16 to finely adjust the amount of heat generation across heat generation range of the rotational member 1.

2) Control of Rotational Member 1 in Heat Generation Pattern in its Lengthwise Direction Next, parts (a)-(d) of FIG. 15 show how the heat generation pattern of the rotational member 1 in terms of its lengthwise direction is controlled in this embodiment. Part (a) of FIG. 15 shows the waveform of the high frequency voltage applied to the rotational member 1 to make the rotational member 1 roughly uniform in the amount of heat generation in terms of its lengthwise direction as indicated by a solid line in part (d) of FIG. 15, which shows the heat generation pattern of the rotational member 1. In the case of the high frequency voltage having the waveform shown in part (a) of FIG. 15, the pulse cycle duration 20 is 11.1E-6 seconds (90 kHz). The burst cycle duration 22 and burst duration 23, are the same in length, that is, 11.1E-6E, as the pulse cycle duration 20. The pulse duration 21 is 5.0E-6 seconds.

Part (b) of FIG. 15 shows the waveform of the high frequency voltage when the heat generation pattern of the rotational member 1 is such that the center portion of the rotational member 1, in terms of its lengthwise direction, is greater in the amount of heat generation than the lengthwise end portions, as indicated by a single-dot chain line in part (d) of FIG. 15, which shows the heat generation patterns of the rotational member 1. In the case of the high frequency voltage having the waveform shown in part (b) of FIG. 15, the pulse cycle duration 20 is 22.2E-6 seconds (45 kHz); burst cycle duration 22 and burst duration 23, 22.2E-6 seconds, which is the same as the pulse cycle duration 20; and pulse duration 21 is 10.0E-6 seconds.

Part (c) of FIG. 15 shows the waveform of the high frequency voltage when the rotational member 1 was controlled in temperature so that the value of the temperature detected by the temperature detection element 9 became and remained at a preset unshown value as indicated by a broken line in part (d) of FIG. 15, which shows the waveform of the high frequency voltage, and also, so that the heat generation pattern of the rotational member 1 became such that the center portion of the rotational member 1 was greater in the amount of heat generation in terms of its lengthwise direction than the end portions as indicated by the solid line in part (d) of FIG. 15. In the case of the high frequency voltage having the waveform shown in part (c) of FIG. 15, the pulse cycle duration 20, pulse duration 21, and burst duration 23 are the same as those in part (b) of FIG. 15. The rotational member 1 can be reduced in the amount of heat generation by extending the burst cycle duration 22 to 33.3E-6 seconds.

However, in a case when the above-described power component attributable to the burst duration 22 effects the heat generation pattern of the rotational member 1, the pulse duration 21 and/or burst duration 23 are adjusted according to the value of the temperature detected by the second temperature detection element 10, and that of the third temperature detection element 11, in order to finely adjust the heat generation area of the rotational member 1. Further, the heat generation range of the rotational member 1 can be finely adjusted by readjustment of the pulse cycle duration 20, instead of the pulse duration 21, and/or burst duration 22. Needless to say, the rotational member 1 can be finely adjusted in its heat generation range by the adjustment of two or more of the four control parameters, or all the parameters.

Next, referring to FIG. 16 (flowchart), the procedure to set initial values for the pulse cycle duration 20, pulse duration 21, burst cycle duration 22, burst duration 23 to control the rotational member 1 in heat generation pattern is described. It is assumed here that two types of recording medium sheets, which are different in size in terms of the lengthwise direction of the rotational member 1 are used. More specifically, two types of sheet of recording medium, the size of which are A4 and B5, are used as sheets of large and small sizes for image formation in FIG. 16.

As a sheet of recording medium of a size A4 is selected as the recording medium, in response to an unshown print signal, a sequence, shown in FIG. 6, for setting initial values for the parameters is started. First, "A4", or a large size, is read as recording medium size in Step S201. Next, whether or not the recording medium size is small (=B5) is determined. Here, the recording medium size is A4. "NO" (=large size) is selected as the answer, because the recording medium size is A4. Then, the next step, or Step S203, is taken.

Thereafter, the pulse cycle duration 20, pulse duration 21, burst cycle duration 23, and burst cycle duration 22 are all set to short S, in Step S203. In this embodiment, as described with reference to part (a) of FIG. 15, pulse cycle duration 20 is set to 11.1E-6 seconds (90 kHz); pulse duration 21, 5.0E-6 seconds; burst cycle duration 22, 11.1E-6 seconds; and burst cycle duration 23 is set to 11.1E-6 seconds, ending the sequence.

On the other hand, if sheets of recording medium, which are B5 (small) in size are selected in response to the unshown print signal. The sequence, shown in FIG. 16, for setting initial values of the parameters is started. First, "B5" (=small) is read as recording medium size in Step S201. Next, in Step S202, it is determined in Step S202 whether or not recording medium is small in size. Here, recording medium size is B5. Therefore, it is determined that recording medium has a small size (B=small). Since the recording medium size is (=B5), the answer is "Yes". Then, the next step, that is, Step S204, of the sequence is taken.

Thereafter, the initial values are set for the four parameters in Step S204. That is, the pulse cycle duration, pulse duration, burst cycle duration, and burst duration, are all set to be long L. More specifically, in this embodiment, the pulse cycle duration 20 is set to 22.2E-6 seconds (45 kHz); pulse duration 21, 10.0E-6 seconds; burst cycle duration 22, 22.2E-6 seconds; and burst duration 23 is set to 22.2E-6 seconds, as shown in part (b) of FIG. 5A. Then, the sequence is ended.

Thus, the heating range of the rotational member 1 can be controlled according to recording medium size. That is, the heat generation pattern of the rotational member 1 can be controlled as indicated by a solid line in part (d) of FIG. 15, in a case when the recording medium to be used for image formation is large, and by a broken line or a single-dot chain line in part (d) of FIG. 15 in a case when recording medium is small in size in terms of the widthwise direction.

By the way, this embodiment was described with reference to a case in which two types (in size) of sheet of recording medium are used for image formation. However, even if two or more types of sheet of recording medium in terms of size are used for image formation, all that is necessary is to carry out a procedure which is similar to the above-described one, although it will be greater in the number of steps. The aforementioned fixing procedure is carried out after the completion of this procedure.

As described above, according to this embodiment, all of the four control parameters, shown in FIG. 7, are used to control the rotational member 1 in the heat generation pattern and amount of heat generation. Therefore, it is possible to provide a fixing apparatus which is simple in structure, and yet, is capable of causing its heat generating member to generate heat in such a pattern that matches recording medium size, by such an amount that matches recording medium size.

Embodiment 4

This embodiment also deals with two or more types of sheet of recording medium in terms of size, like the first, second, and third embodiments. Regarding the method for controlling the rotational member 1 in temperature, and the high frequency converter, this embodiment is the same as the first one. That is, the electric power controlling means 15 controls the rotational member 1 in temperature by controlling at least one (burst cycle duration, in reality) of the four parameters (duration), based on the output of the first temperature detecting means 9 positioned in contact with the inward surface of the rotational member 1 in terms of the lengthwise direction of the rotational member 1. This embodiment is different in the waveform of the high frequency voltage from the preceding embodiments (FIGS. 10, 11 and 13). More specifically, it is different from the preceding embodiments in that in this embodiment, the waveform of the high frequency voltage is such that the positive and negative sides are different in shape.

FIG. 17 shows the waveform of the high frequency voltage outputted by the high frequency converter 16 in this embodiment. Referring to FIG. 17, the waveform is such that the shape of the positive side is rectangular, whereas the shape of the negative side is a combination of rectangle and arc. Reference numeral 20 stands for the pulse cycle duration. Reference numeral 21 stands for the duration of rectangular portion. Reference numeral 29 stands for the duration of arc-rectangle portion. Reference numeral 22 stands for the burst cycle duration. Reference numeral 23 stands for burst duration. This type of waveform also can be expressed in the following form of time function by Fourier series development.

$$V(t) = \alpha \cdot \sin\frac{2\pi}{T}t + \beta \cdot \sin\frac{2 \cdot 2\pi}{T}t + \gamma \cdot \sin\frac{3 \cdot 2\pi}{T}t + \delta \cdot \sin\frac{4 \cdot 2\pi}{T}t + \varepsilon \cdot \sin\frac{5 \cdot 2\pi}{T}t + \ldots \quad (2)$$

Here, α, β, γ . . . stand for constants which become available as soon as the waveform is set. High frequency voltage having such a waveform as the one shown in FIG. 17 can be expressed as the sum of sinusoidal waves (each term) like Formula (1) in the first embodiment.

Next, referring to parts (a)-(b) of FIG. 18, the waveform of the high frequency voltage, and how to make the rotational member 1 uniform in the amount of heat generation in terms of the lengthwise direction of the rotational member 1, are described. It is assumed here that the rotational member 1 is made uniform in the amount of heat generation in terms of its lengthwise direction when the high frequency voltage is not controlled in burst as shown in part (a) of FIG. 18. Here, the rotational member 1 may be made uniform in the amount of heat generation when the high frequency voltage is being controlled in burst. As a decision is made to use high frequency voltage having the waveform shown in part (a) of FIG. 18, the constants α, β, γ . . . in Formula (2) are set in value. Therefore, the rotational member 1 can be set in heat generation pattern by the application of each of the high frequency voltages having such sinusoidal waveforms, between the power supply contact points 3*a* and 3*b*. Therefore, the coil 3 is adjusted in pitch so that the combination of the heat generation patterns of the rotational member 1, which correspond to the terms in Formula (2), one for one, becomes roughly flat.

The heat generation of the rotational member 1 may be controlled by controlling the pulse duration 21 as in the first embodiment, or by adjusting the high frequency converter in burst cycle duration 22, shown in parts (a)-(c) of FIG. 19, as in the third embodiment. In this embodiment, the rotational member 1 is controlled in the amount of heat generation by the lengthening of the burst cycle duration 22 from t0 to t0×2.

Further, the heat generation pattern of the rotational member 1 can also be controlled by controlling the duration the four control parameters as shown in parts (a)-(c) of FIG. 20, as in the first and second embodiments. In this embodiment, the pulse cycle duration 20 was increased from t1 to t6; pulse duration 29, from t3 to t8; burst cycle duration 22, from t4 to t9; and burst duration 23 was changed from t5 to t10. With this adjustment, the heat generation pattern indicated by a solid line in part (c) of FIG. 20 can be changed to the one indicated by a dotted line in Parts (a)-(c) of FIG. 20. The procedure to set initial values for the four control parameters is the same as the one in the second embodiment.

Next, referring to FIG. 21, the high frequency converter in this embodiment is described. Reference numeral 300 stands for a commercial AC power source. Reference numeral 301 stands for a filter. Reference numeral 302 stands for a diode bridge. Reference numeral 303 stands for a coil. Reference numeral 304 stands for a condenser. Reference numerals 305 and 306 stand for switching elements. Reference numerals 307 and 308 stand for condensers. Reference numerals 309 and 310 stand for diodes. Reference numeral 314 stands for an equivalent resistance as the fixing apparatus A is seen from the direction of the power supply contact points 3*a* and 3*b*. Reference numeral 315 stands for an equivalent inductance as the fixing apparatus A is seen from the direction of the power supply contact points 3*a* and 3*b*.

Reference numeral 311 stands for a driving circuit for turning on or off the switching elements 305 and 306 to generate high frequency voltage having a desired waveform. The electric power controlling means 15 includes a portion 312 for controlling the high frequency voltage in pulse cycle duration, a portion 313 for controlling the high frequency voltage in pulse duration, a portion 314 for controlling the high frequency voltage in burst cycle duration, and a portion 315 for controlling the high frequency voltage in burst duration.

At this time, referring to FIG. 22, the operation of the switching elements 305 and 306 of the high frequency converter in this embodiment, which is shown in FIG. 21, is described. Reference numeral 316 stands for the gate source voltage of the switching element 305. Reference numeral 317 stands for the gate source voltage of the switching element 306. Reference numeral 318 stands for the high frequency voltage to be applied between the power supply contact points 3*a* and 3*b*. The hatched areas in FIG. 22 correspond to the periods in which voltage is being applied to the power supply contact points 3*a* and 3*b*. The hatched areas correspond to the pulse durations 21 and 29.

The gate-on period of the switching element 306 corresponds to the pulse duration 21. The pulse duration 21 can be controlled by controlling this period. The gate-on period of the switching element 305 corresponds to the pulse duration 29. The pulse duration 29 can be controlled by controlling this period. The period from the gate-on of the switching element 305 to the next gate-on and the period from the gate-on of the switching element 306 to the next gate-on corresponds to the pulse cycle duration 20. The pulse cycle duration 20 can be controlled by controlling these periods.

Referring to FIG. 23, the period in which the pulse of the gate source voltage 316 is continuous with the pulse of the gate source voltage 317 corresponds to the burst duration 23. The burst duration 23 can be controlled by controlling this period. Referring again to FIG. 23, the sum of the period in which the pulse of the gate-source voltage 316 is continuous with the pulse of the gate source voltage 317, and the period in which there is no pulse corresponds to the burst cycle duration 22. The burst cycle duration 22 can be controlled by controlling this period.

Further, there is provided an unshown dead time between the pulse of the gate source voltage 316 and that of the gate source voltage 317 to prevent the switching elements 305 and 306 from being simultaneously turned on. Moreover, in the foregoing, the control circuit and the controlling method were described with reference to a controlling circuit of the active clamp type. One of the reasons for employing a control circuit of the active clamp type is that a control circuit of the active clamp type is simple in structure. However, this embodiment is not intended to limit the present invention in scope in terms of the control circuit and control method. That is, the present invention is also compatible with any combination of control circuit and control method, as long as the combination can generate and control high frequency voltage having the waveform, shown in FIG. 17, the positive side of which is different in shape from the negative side.

In the foregoing description of this embodiment, the embodiment was described with reference to a case in which high frequency voltage had such a waveform that the positive side of the waveform is sinusoidal, whereas the negative side was in the form of a combination of a rectangle and an arc. This embodiment, however, is not intended to limit the present invention in scope in terms of the waveform of the high frequency voltage. That is, the present invention is also compatible with any high frequency converter which can generate high frequency voltage having such a waveform that its positive side is sinusoidal, whereas the negative side is in the form of a combination of a rectangle and an arc. For example, the present invention is also compatible with a high frequency converter of the voltage resonant circuit type such as the one which will result as the switching element 305 and diode 309 in FIG. 21 are eliminated to short-circuit the circuit.

As described above, according to this embodiment, the fixing apparatus A is structured so that an excitation coil is disposed in the hollow of a rotational member, and a rotational member is made to generate heat by the alternating magnetic field which is generated in the direction parallel to the rotational axis of the rotational member by the application of high frequency voltage to the excitation coil. That is, this embodiment also can provide a fixing apparatus which is substantially simpler in structure than any conventional fixing apparatus based on electromagnetic induction, and yet, can generate a sufficient amount of heat necessary for fixation, while generating heat in such a pattern that matches recording medium size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus comprising:

a cylindrical rotatable member having an electroconductive layer, an inner surface, an outer surface, an inside space, an axial direction, and a circumferential direction;

an opposing member contacting the outer surface of said rotatable member;

a nip forming member contacting the inner surface of said rotatable member and cooperating with said opposing member to form a nip configured to nip and feed a recording material carrying a toner image through said rotatable member;

a magnetic field generating device including an excitation coil provided in the inside space of said rotatable member so that a helicity axis of said excitation coil is in parallel with the axial direction of said rotatable member, said magnetic field generating device configured to produce an induced current in the circumferential direction of said rotatable member by supplying an AC current to said excitation coil;

a converter configured to apply a high frequency voltage to said excitation coil, wherein control parameters relating to the high frequency voltage of said converter include four control times including a pulse period, a pulse-on time, a burst period, and a burst-on time;

at least one temperature detector configured to detect a temperature of said rotatable member; and a controller configured to control said converter, wherein said controller controls the temperature of said rotatable member by controlling at least one of the four control times.

2. The image heating apparatus according to claim 1, wherein said controller controls the temperature of said rotatable member using two or more of the four control times in combination.

3. The image heating apparatus according to claim 1, wherein said controller controls heat generation and distribution of said rotatable member by controlling at least one of the four control times on the basis of an output of said temperature detector and a size of the recording material.

4. The image heating apparatus according to claim 1, wherein said temperature detector includes a first temperature detector configured to detect a temperature of said rotatable member at a central position in the axial direction of said rotatable member, and a second temperature detector configured to detect a temperature of said rotatable member at an end portion in the axial direction of said rotatable member, and wherein said controller controls at least one of the four control times on the basis of outputs of said first temperature detector and said second temperature detector.

5. The image heating apparatus according to claim 1, wherein said converter includes a full bridge type circuit.

6. The image heating apparatus according to claim 1, wherein positive and negative parts of an output waveform of said converter have shapes different from each other.

7. The image heating apparatus according to claim 6, wherein said converter includes an active clamp type circuit.

8. The image heating apparatus according to claim 1, wherein said magnetic field generating device includes a magnetic core extending between opposite end portions of said excitation coil in said excitation coil, and said magnetic core has a non-endless shape.

* * * * *